US007909017B2

(12) United States Patent
Yang

(10) Patent No.: US 7,909,017 B2
(45) Date of Patent: Mar. 22, 2011

(54) ENGINE BRAKING APPARATUS WITH MECHANICAL LINKAGE AND LASH ADJUSTMENT

(76) Inventor: Zhou Yang, Oak Ridge, NC (US)

( * ) Notice: Subject to any disclaimer, the term of this patent is extended or adjusted under 35 U.S.C. 154(b) by 0 days.

(21) Appl. No.: 12/854,716

(22) Filed: Aug. 11, 2010

(65) Prior Publication Data

US 2010/0300403 A1 Dec. 2, 2010

Related U.S. Application Data

(63) Continuation of application No. 12/217,813, filed on Jul. 9, 2008, now Pat. No. 7,789,065.

(51) Int. Cl.
*F02D 13/04* (2006.01)
*F02D 13/08* (2006.01)

(52) U.S. Cl. ..... 123/321

(58) Field of Classification Search ..... 123/321, 123/320, 319, 90.12, 90.16, 345, 346
See application file for complete search history.

(56) References Cited

U.S. PATENT DOCUMENTS

| | | | | |
|---|---|---|---|---|
| 4,836,162 | A * | 6/1989 | Melde-Tuczai et al. | 123/321 |
| 5,205,247 | A * | 4/1993 | Hoffman | 123/90.16 |
| 5,626,116 | A | 5/1997 | Reedy | |
| 6,189,504 | B1 | 2/2001 | Israel | |
| 6,244,257 | B1 | 6/2001 | Hu | |
| 6,354,254 | B1 * | 3/2002 | Usko | 123/90.16 |
| 6,415,752 | B1 | 7/2002 | Janak | |
| 7,028,664 | B2 * | 4/2006 | Wolf | 123/321 |
| 2002/0174849 | A1 | 11/2002 | Ruggiero | |
| 2004/0025835 | A1 * | 2/2004 | Sieber et al. | 123/321 |
| 2005/0211206 | A1 * | 9/2005 | Ruggiero et al. | 123/90.16 |
| 2006/0081213 | A1 * | 4/2006 | Yang et al. | 123/321 |

FOREIGN PATENT DOCUMENTS

| | | |
|---|---|---|
| WO | WO 90/09514 | 8/1990 |
| WO | WO 97/06355 | 2/1997 |

OTHER PUBLICATIONS

International Search Report for PCT/US2009/069622, mailed Oct. 7, 2010, 6 pgs.
U.S. Appl. No. 12/348,320, filed Jan. 5, 2009, Yang.
U.S. Appl. No. 12/348,317, filed Jan. 5, 2009, Yang.
U.S. Appl. No. 12/261,031, filed Oct. 30, 2008, Yang.
U.S. Appl. No. 12/217,813, filed Jul. 9, 2008, Yang.

* cited by examiner

*Primary Examiner* — Mahmoud Gimie
(74) *Attorney, Agent, or Firm* — Squire, Sanders & Dempsey (US) LLP

(57) ABSTRACT

Apparatus for modifying engine valve lift to produce an engine valve event in an internal combustion engine, the engine including at least one exhaust valve and an exhaust valve lifter for cyclically opening and closing the at least one exhaust valve, includes (a) an actuator for operating the at least one exhaust valve to produce said modified engine valve lift, said actuator having an inoperative position and an operative position; in said inoperative position said actuator being disengaged from the operation of the at least one exhaust valve, and in said operative position said actuator opening the at least one exhaust valve for said engine valve event; and (b) a controller for moving said actuator between said inoperative position and said operative position.

17 Claims, 16 Drawing Sheets

ENGINE BRAKING APPARATUS WITH MECHANICAL LINKAGE AND LASH ADJUSTMENT

This application is a continuation of application Ser. No. 12/217,813, filed Jul. 9, 2008 now U.S. Pat. No. 7,789,065.

BACKGROUND OF THE INVENTION

1. Field of Invention

The present invention relates generally to the modification of engine valve lift for producing an engine valve event in an internal combustion engine, particularly to engine braking apparatus and methods for converting an internal combustion engine from a normal engine operation to an engine braking operation.

2. Prior Art

It is well known in the art to employ an internal combustion engine as brake means by, in effect, converting the engine temporarily into a compressor. It is also well known that such conversion may be carried out by cutting off the fuel and opening the exhaust valve(s) at or near the end of the compression stroke of the engine piston. By allowing compressed gas (typically, air) to be released, energy absorbed by the engine to compress the gas during the compression stroke is not returned to the engine piston during the subsequent expansion or "power" stroke, but dissipated through the exhaust and radiator systems of the engine. The net result is an effective braking of the engine.

An engine brake is desirable for an internal combustion engine, particularly for a compression ignition type engine, also known as a diesel engine. Such engine offers substantially no braking when it is rotated through the drive shaft by the inertia and mass of a forward moving vehicle. As vehicle design and technology have advanced, its hauling capacity has increased, while at the same time rolling and wind resistances have decreased. Accordingly, there is a heightened braking need for a diesel-powered vehicle. While the normal drum or disc type wheel brakes of the vehicle are capable of absorbing a large amount of energy over a short period of time, their repeated use, for example, when operating in hilly terrain, could cause brake overheating and failure. The use of an engine brake will substantially reduce the use of the wheel brakes, minimize their wear, and obviate the danger of accidents resulting from brake failure.

There are different types of engine brakes. Typically, an engine braking operation is achieved by adding an auxiliary engine valve event called an engine braking event to the engine valve event for the normal engine operation. Depending on how the engine valve event is produced, an engine brake can be defined as:

(a) Type I engine brake—the engine braking event is produced by importing motions from a neighboring cam, which generates the so called Jake brake;

(b) Type II engine brake—the engine braking event is produced by altering existing cam profile, which generates a lost motion type engine brake;

(c) Type III engine brake—the engine braking event is produced by using a dedicated cam for engine braking, which generates a dedicated cam (rocker) brake;

(d) Type IV engine brake—the engine braking event is produced by modifying the existing valve lift, which normally generates a bleeder type engine brake; and (e) Type V engine brake—the engine braking event is produced by using a dedicated valve train for engine braking, which generates a dedicated valve (the fifth valve) engine brake.

The engine brake can also be divided into two big categories, i.e., the compression release engine brake (CREB) and the bleeder type engine brake (BTEB).

Compression Release Engine Brake (CREB)

Conventional compression release engine brakes (CREB) open the exhaust valve(s) at or near the end of the compression stroke of the engine piston. They typically include hydraulic circuits for transmitting a mechanical input to the exhaust valve(s) to be opened. Such hydraulic circuits typically include a master piston which is reciprocated in a master piston bore by a mechanical input from the engine, such as the pivoting movement of the fuel injector rocker arm. Hydraulic fluid in the circuit transmits the motion of the master piston to a slave piston in the circuit, which in turn, reciprocates in a slave piston bore in response to the flow of hydraulic fluid in the circuit. The slave piston acts either directly or indirectly on the exhaust valve(s) to be opened during the engine braking operation. This is a Type I engine brake.

An example of a prior art CREB is provided by the disclosure of Cummins, U.S. Pat. No. 3,220,392 ("the '392 patent"), which is hereby incorporated by reference. Engine braking systems based on the '392 patent have enjoyed great commercial success. However, the prior art engine braking systems have certain inherent disadvantages that have limited their application to primarily larger vehicles such as heavy duty trucks (and typically, on engines having a displacement of about 10 liters or more), and their retrofit to existing engines is largely impossible without substantial modification of the engine cylinder head.

One of the disadvantages associated with the conventional prior art CREB system is due to the fact that the load from engine braking is supported by the engine components. Because the engine braking load is much higher than the normal engine operation load, many parts of the engine, such as the rocker arm, the push tube, the cam, etc. must be modified to accommodate the engine braking system. Thus, the overall weight, height, and cost of using the prior art CREB system are likely to be excessive, and limit its commercial application.

Another disadvantage associated with the conventional prior art CREB system is the high and unique noise generated by the releasing of high-pressure gas or "blow down" through the exhaust valve(s) during the compression stroke, near the top dead center position of the engine piston.

Additional disadvantages of the prior art systems reside in their relative complexity and the necessity for using precision components because they require accurate timing and hydraulic actuators capable of opening the exhaust valves precisely when required. Thus they may be comparatively expensive and difficult or impossible to install on certain engines.

Yet another disadvantage associated with the conventional prior art CREB system of hydraulic type is the compliance of the braking system, which may cause the braking valve lift to collapse at the peak braking load (near compression top dead center (TDC) of the engine piston) and further increase the braking load. The large reduction of braking valve lift due to compliance will reduce the braking performance and excessive braking load may cause engine damage.

Bleeder Type Engine Brake (BTEB)

The operation of a bleeder type engine brake (BTEB) has also long been known. During bleeder type engine braking, in addition to the normal exhaust valve lift, the exhaust valve(s) may be held slightly open during a portion of the cycle (partial-cycle bleeder brake) or open continuously throughout the non-exhaust strokes (intake stroke, compression stroke, and expansion or power stroke) (full-cycle bleeder brake). The primary difference between a partial-cycle bleeder brake and a full-cycle bleeder brake is that the former does not have exhaust valve lift during most of the intake stroke. An example of BTEB system and method is provided by the disclosure of the present inventor, U.S. Pat. No. 6,594,996, which is hereby incorporated by reference.

Usually, the initial opening of the braking valve(s) in a bleeder braking operation is far in advance of the compression TDC and then the braking valve lift is held constant for a period of time. As such, a BTEB may require much lower force to open the valve(s) due to early valve actuation, and generates less noise due to continuous bleeding instead of the rapid blow down of the CREB. Moreover, a BTEB often requires fewer components and can be manufactured at a lower cost. Thus, a BTEB can overcome some of the disadvantages of the CREB. Indeed, the BTEB systems have achieved certain commercial success, especially in the application to smaller vehicles, such as the middle and light duty trucks (and typically, on engines having a displacement of less than 10 liters). Following are some BTEB systems that are currently on the market.

(a) BTEB Operated by Rocker Arm with Eccentric Shift

U.S. Pat. No. 5,335,636 discloses a bleeder type engine brake (BTEB) system wherein the pivot center of the engine exhaust rocker arm is displaced or shifted in a downward direction by an eccentric that is connected to a hydraulic piston/actuator by a level arm. The displacement or shift of the rocker arm pivot center causes the exhaust valves to open during braking operation of the engine to create a partial cycle bleeder braking event. This is a Type IV engine brake.

The BTEB system of the type described above requires an extra mechanical component between the hydraulic piston or actuator and the rocker arm. The system also requires intermediate arms, a second rocker arm eccentric bore, features on the small end of the actuation/pivot arm and features on the mechanical actuation end of the piston. These parts and features all add cost and complexity, and reduce system reliability. Also, the system is integrated into the engine exhaust valve train. Load from engine braking by opening both exhaust valves is so high that other parts of the engine, such as the rocker arm, the push tube, the cam, etc. must be redesigned. Finally, such type of engine brakes cannot be retrofitted into existing engines.

(b) BTEB Operated by a Dedicated Engine Braking Valve

U.S. Pat. No. 5,168,848 discloses a bleeder type engine brake (BTEB) system that has an extra exhaust valve in addition to the normal engine exhaust valve(s). The extra exhaust valve is dedicated to engine braking and opened exclusively during braking operation of the engine. The dedicated engine braking valve is actuated by pneumatic or hydraulic means and held open to create a full cycle bleeder braking event. This is a Type V engine brake.

The BTEB system of the type described above is integrated into the cylinder head of the engine, thereby substantially conditioning its design and manufacture. The engine braking device is therefore dedicated to a particular type of engine. Moreover, the introduction of the extra exhaust valve creates an extra pocket in the combustion chamber, which increases engine emission. Also, such type of engine brakes can not be used in existing engines.

(c) BTEB Operated by Engine Valve Floating

U.S. Pat. No. 5,692,469 and U.S. Pat. No. 7,013,867 disclose a bleeder type engine brake (BTEB) system for engines with one and two exhaust valves per cylinder. The BTEB system includes a throttling device (also known as an exhaust brake) capable of raising exhaust pressure high enough to cause each exhaust valve to float near the end of each intake stroke. In this intermediate opening or floating of the exhaust valve, it is possible to intervene with the braking device so that the exhaust valve, which is about to close after the intermediate opening, is intercepted by a control piston charged with oil pressure and prevented from closing to create a partial cycle bleeder braking event. This is a Type IV engine brake.

The BTEB system of the type described above may not be reliable because it depends on the intermediate opening or floating of the braking exhaust valve, which is not consistent, both in timing and magnitude. As is well known in the art, exhaust valve floating is highly engine speed dependent and affected by the quality and control of the exhaust brake, and also the design of the exhaust manifold. There may be not enough or none valve floating for the actuation of the engine braking device at middle and low engine speeds when the engine brake is highly demanded since the engine is mostly driving at such speeds. Again, such type of engine brakes may not be able to retrofit into existing engines.

(d) BTEB Operated by High-Pressure Oil

U.S. Pat. No. 6,866,017 and U.S. Pat. No. 6,779,506 disclose a bleeder type engine brake (BTEB) that is actuated and controlled by high-pressure hydraulic fluid, or oil. The hydraulic fluid is supplied from a hydraulic rail, or oil rail, to a respective fuel injector at each engine cylinder to act on a piston in the fuel injector to force a charge of fuel into the respective combustion chamber during normal engine operation. A hydraulic actuator in the engine brake uses the already available high-pressure oil to actuate and hold one exhaust valve open to create a full cycle bleeder braking event. This is also a Type IV engine brake.

The BTEB system of the type described above is dedicated to a particular type of engine that has high-pressure oil rail (source), which greatly limits its application. Sophisticated electronic control is needed to eliminate excessive oscillations of the shared common high pressure source and to ensure a smooth transition between engine braking operation and normal engine operation. Also, such type of engine brakes cannot be retrofitted into existing engines.

It is clear from the above description that the prior-art engine brake systems have one or more of the following drawbacks:

(a) The system can only be installed on a particular type of engines;

(b) The system cannot be retrofitted to existing engines;

(c) The engine braking load is carried by the engine components;

(d) The system installment needs redesign of the engine or engine components;

(e) The system has too many components and is too complex;

(f) The system increases the manufacturing tolerance requirements and is too costly;

(g) The system is not reliable and only work at certain engine speeds; and (h) The system affects normal engine performance (emission, oil rail pressure, etc.).

SUMMARY OF THE INVENTION

The engine braking apparatus of the present invention addresses and overcomes the foregoing drawbacks of prior art engine braking systems.

One object of the present invention is to provide an engine braking apparatus that can be installed on all types of engines, especially on smaller size engines.

Another object of the present invention is to provide an engine braking apparatus that can be retrofitted to existing engines.

Yet another object of the present invention is to provide an engine braking apparatus wherein the engine (valve train) components are not subject to the heavy engine braking loads so that the installment of the engine braking apparatus does not need redesign of the engine or engine components.

Still another object of the present invention is to provide an engine braking apparatus with fewer components, reduced complexity, lower cost, and increased system reliability.

A further object of the present invention is to provide such an engine braking apparatus that contains a braking valve lash adjusting mechanism so that it does not increase the manufacturing tolerance requirements of many of the components.

Still a further object of the present invention is to provide an engine braking apparatus that is rugged and simple in construction, easy to install, reliable in operation and effective at all engine speeds.

Yet a further object of the present invention is to provide engine brake actuation means that transmit force, or the engine braking load, through mechanical linkage means that does not have high compliance and overloading problems associated with hydraulic means. The mechanical linkage means includes rotatable devices, slidable devices, ball-locking devices, and a toggle device.

Still another object of the present invention is to provide an engine braking apparatus that will not interfere with the normal engine operation.

These and other advantages of the present invention will become more apparent from the following description of the preferred embodiments in connection with the following figures.

DETAILED DESCRIPTION OF THE PREFERRED EMBODIMENTS

Reference will now be made in detail to presently preferred embodiments of the invention, examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 1:
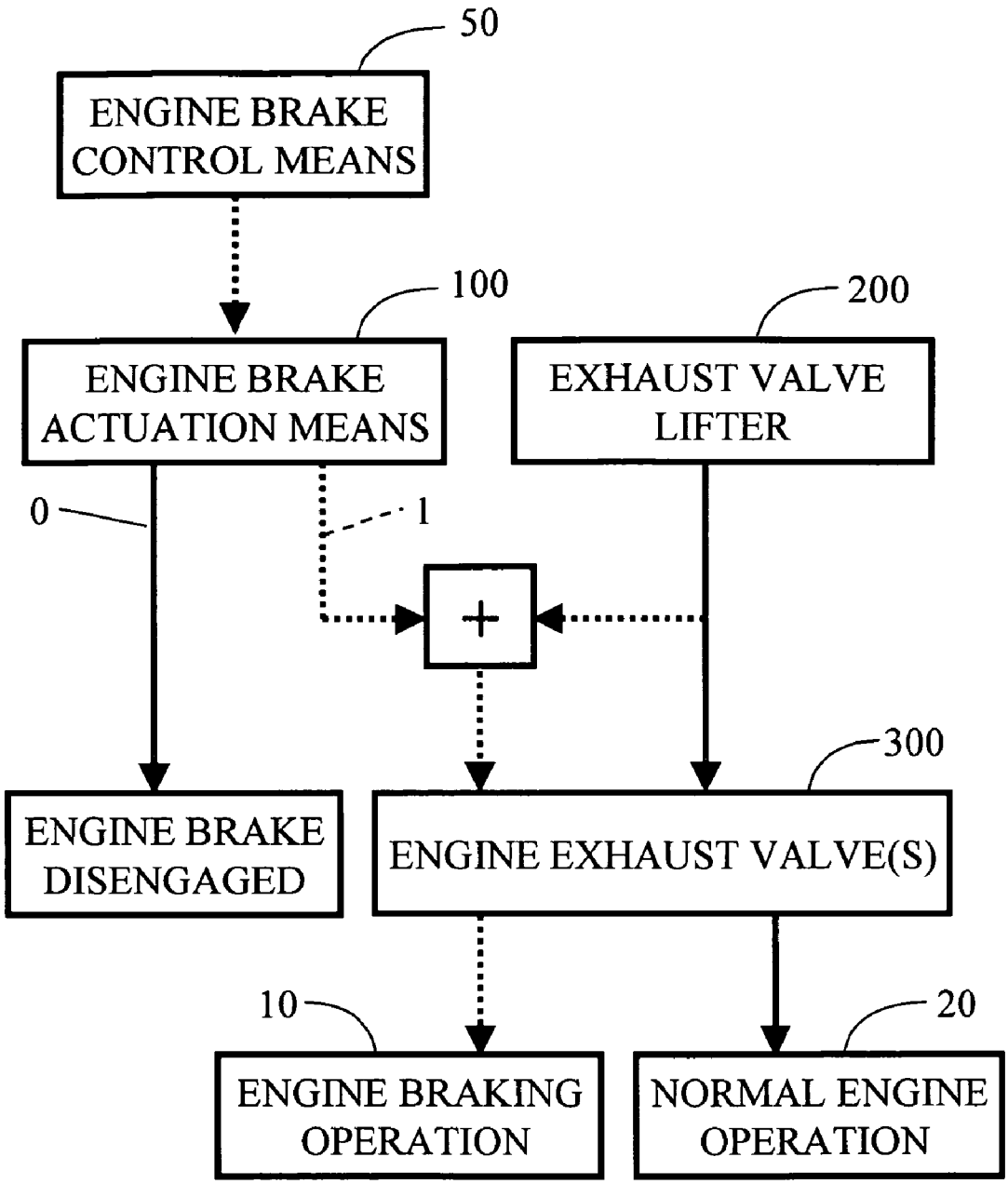
FIG. 1 is a flow chart illustrating the general relationship between a normal engine operation and an added engine braking operation according to one version of the present invention.

FIG. 1 is a flow chart illustrating the general relationship between a normal engine operation 20 and an added engine braking operation 10 according to one version of the present invention. An internal combustion engine contains at least one exhaust valve 300 and an exhaust valve lifter 200 for cyclically opening and closing the exhaust valve during the normal engine operation 20. The engine braking operation 10 is achieved through engine brake control means 50 and engine brake actuation means 100 that contains an inoperative position 0 and an operative position 1. To convert the engine from its normal operation 20 to the braking operation 10, the control means 50 will move the actuation means 100 from the inoperative position 0 to the operative position 1, which takes place after the exhaust valve 300 is actuated by the exhaust valve lifter 200. By default, the control means 50 is at its off position, the actuation means 100 at the inoperative position 0, and the engine brake disengaged from the exhaust valve 300.

Figure 2:
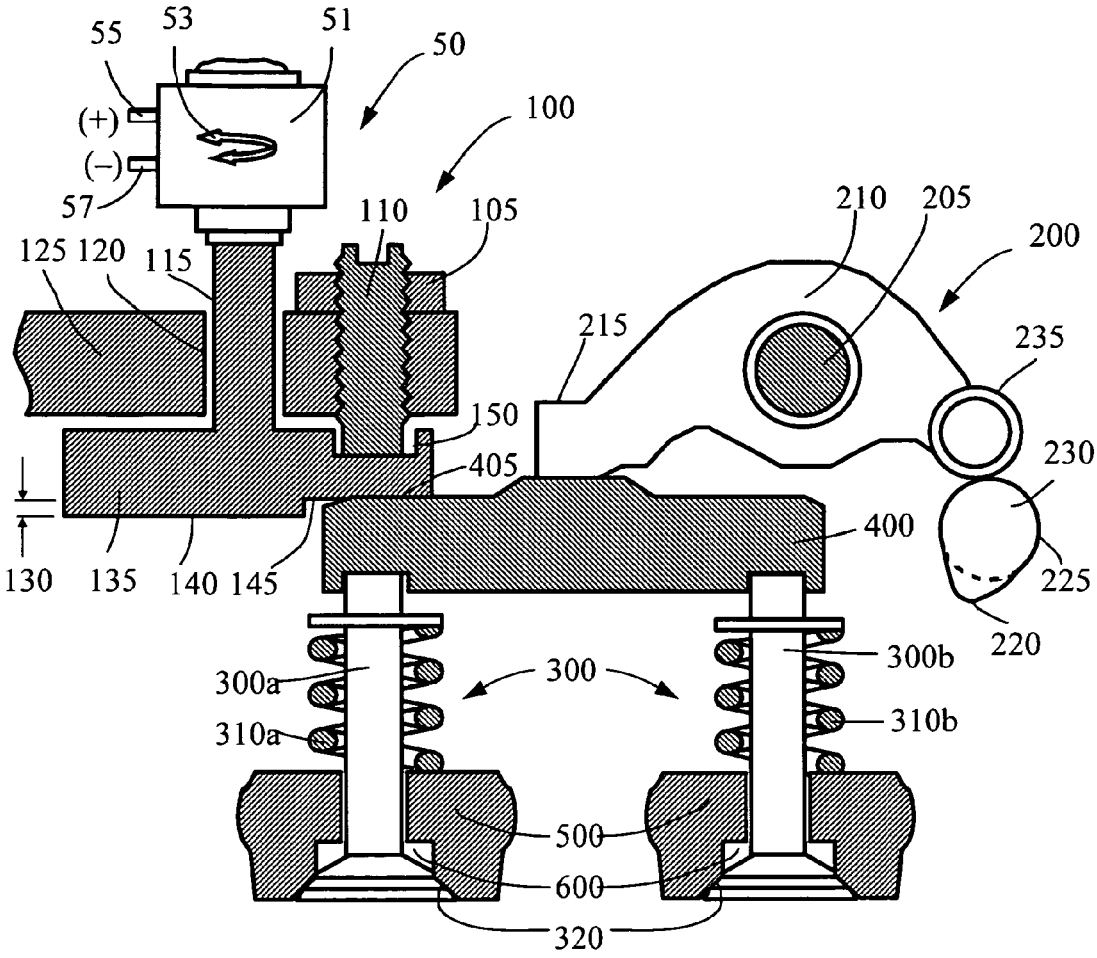
FIG. 2 is a schematic diagram of an engine braking apparatus with an exhaust valve train of the engine according to a first embodiment of the present invention.

FIG. 2 is a schematic diagram of an engine braking apparatus with an engine exhaust valve train according to one embodiment of the present invention. A typical truck engine has two exhaust valves 300*a* and 300*b* per engine cylinder. The two valves are biased upwards against their seats 320 on the engine cylinder head 500 by engine valve springs 310*a* and 310*b* to seal gas (air, during engine braking) from flowing between the engine cylinder and the exhaust manifolds 600. The exhaust valve lifter 200 includes a rocker arm 210 pivotally mounted on a rocker shaft 205 for transmitting a mechanical input from a cam 230 to the exhaust valves through a cam follower 235 and a valve bridge 400. The cam contains a lift profile 220 above the Cain inner base circle 225 for cyclically opening and closing the exhaust valves during the normal engine operation.

With continued reference to FIG. 2, the engine brake actuation means 100 includes a brake housing 125 that is fixed on the engine block (not shown). In the brake housing there is a bore 120, in which a rotatable device 135 with a stem 115 rotates. Underneath the rotatable device there are two surfaces 140 and 145 that have a height difference 130. The first surface 140 is commensurate with the operative position for the engine braking operation and the second surface 145 commensurate with the inoperative position for the normal engine operation. The rotatable device 135 is biased to the inoperative position by an engine brake control means 50 that is also fixed on the engine block. The control means 50 comprises an electromechanical system that may contain an electric motor 51, such as the well-known step motor, which has a predetermined rotational angle 53. The electric motor is turned on and off by electric current through the positive and negative terminals 55 and 57 on the electric motor.

The actuation means 100 as shown in FIG. 2 is at its inoperative position and the engine brake is disengaged from the engine operation. When engine brake is needed, the control means 50 is turned on, which tends to rotate the actuation means 100 into the operative position. However, there is an intervention between the rotatable device 135 and the valve bridge 400 when the exhaust valve 300*a* is at or near its seat 320. The actuation means 100 is waiting for the lift or opening of the exhaust valve. Only after the exhaust valve 300*a* is pushed down by the exhaust valve lifter 200, the actuation means 100 can be rotated into its operative position at which the first surface 140 will be over the valve bridge surface 405. When the exhaust valve 300*a* returns, the valve bridge surface 405 will contact the first surface 140 on the actuation means 100. Due to the height difference 130 between the first surface 140 and the second surface 145, the exhaust valve 300*a* pushed out by the exhaust valve lifter 200 cannot close or return to its seat 320 but is held open to create an engine braking event.

The engine brake according to the embodiment shown in FIG. 2 is a bleeder type or Type IV engine brake. The engine braking event is produced by modifying the existing engine valve lift. The modified lift of the engine braking valve 300*a* by the actuation means 100 during non-exhaust strokes (intake stroke, compression stroke, and expansion or power stroke) is approximately 0.5 to 3.0 millimeters, much smaller than the lift of the same engine valve by the exhaust valve lifter 200 during the engine exhaust stroke. Such a small lift is within the regular valve seating ramp and the impact load between the actuation means 100 and the braking valve 300*a* is small. However, we can further reduce such impact load by improving the existing exhaust valve lift profile with an even slower seating ramp starting before the valve 300*a* contacts the actuation means 100.

The load generated by the engine braking event according to the embodiment of the present invention is not passed to the exhaust valve lifter 200, but to the engine block through a lash adjusting screw 110 that is secured to the brake housing 125 by a lock nut 105, which avoids the excessive overall engine weight, height, and cost that were experienced with some prior art engine braking systems whose load is carried by the engine components.

A lash adjusting system with the lash adjusting screw 110 and the rotatable device 135 that is also slidable in the housing is designed for setting a lash between the actuation means 100 and the braking valve 300*a*. The braking valve lash adjustment is necessary due to engine valve growth and manufacturing tolerance. The height difference 130 between the first surface 140 and the second surface 145 minus the braking valve lash determines the braking valve lift for the engine braking event or operation. Also, the lash adjusting screw 110 sits in a circumferential groove 150 in the rotatable device 135, which forms a motion limiting means that can be used to control the rotational angle between the inoperative position and operative position.

Since the engine braking valve lift is controlled through the lash adjustment, not by a stroke limited piston, it is much less affected by the dimensional tolerance of the engine brake components. Therefore, the engine braking apparatus according to the embodiment of the present invention avoid using high cost precision components that some prior art engine braking systems require.

Figure 3:
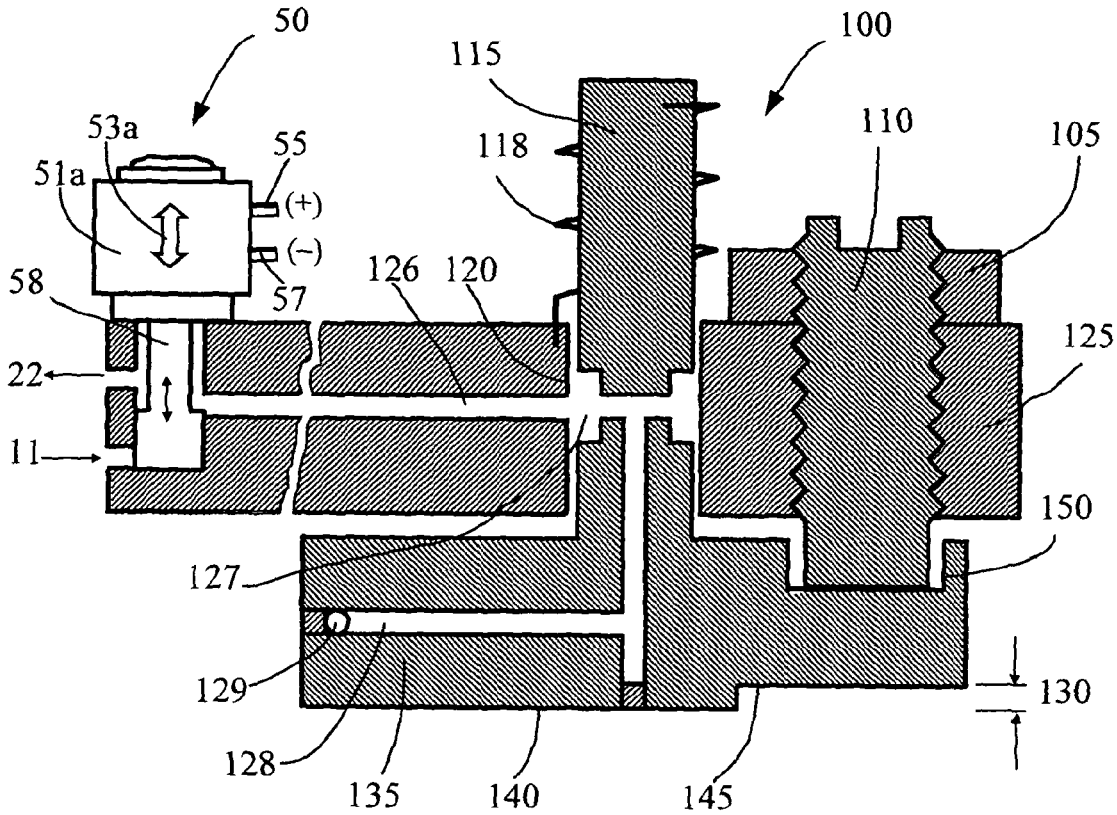
FIG. 3 is a schematic diagram of an engine braking apparatus according to a second embodiment of the present invention.

FIG. 3 shows a similar embodiment to that shown in FIG. 2 except that the engine brake control means 50 is an electro-hydromechanical system that contains a three-way solenoid valve 51*a*. The solenoid valve 51*a* has a spool 58 with a predetermined stroke 53*a* and is turned on and off by an electric current through the positive and negative terminals 55 and 57. The control means 50 could be remotely located and used for controlling multiple cylinder engine brakes. A fluid circuit is formed in the engine brake actuation means 100 and in the engine for transmitting hydraulic fluid, for example, engine oil, from the control means 50 to the actuation means 100. When the spool 58 slides in the brake housing 125, it opens or closes a port (an orifice) 11 or 22 to allow the engine oil into or out of the fluid circuit including a flow passage 126 in the brake housing 125. There is an annular cut or groove 127 on the stem 115 through which the pressurized engine oil can pass to a flow passage 128 and spray out of a bleeding orifice 129 in the rotatable device 135 when the engine brake is turned on.

The rotatable device 135 is biased against the adjusting screw 110 to the inoperative position by a spring 118 that can provide both compressional and torsional preload. One end of the spring 118 is fixed in the brake housing 125 and the other end in the rotatable device 135. When the liquid flows out of the bleeding orifice 129, it generates a jet propulsion force opposite to the flow jet direction, which overcomes the torsional preload by the spring 118 and rotates the rotatable device 135 from the inoperative position into the operative position when the engine braking valve is pushed down by the exhaust valve lifter 200. The angle of rotation is controlled by a motion limiting means defined by the circumferential groove 150 in the rotatable device 135, which has stop surfaces against the adjusting screw 110.

When engine braking is not needed, the three-way solenoid valve 51*a* is turned off and the spool 58 will close the oil supply port 11 and open the drain port 22 (FIG. 3). There will be no oil jet flow out of the bleeding orifice 129 and thus no propulsion force on the rotatable device 135 so that it will return back to the inoperative position by the spring 118, and the actuation means 100 will be disengaged from the normal engine operation. Note that the drain port 22 may be not needed for turning off the engine brake due to the bleeding orifice 129. Therefore, a two-way solenoid valve plus the bleeding orifice may be used to replace the three-way solenoid valve 51*a*.

Alternatively, the rotation of the rotatable device 135 can be achieved by other types of fluid and mechanical interaction, such as jet flow out of the brake housing 125 that impinges on the rotatable device 135 with an impulsion force; hydraulic piston in the brake housing 125 that acts on the rotatable device 135; or mechanical means, such as gear system or rope and pulley system; electric means; magnetic means; and a combination of two or more of the above means, such as the electrohydromechanical system.

Figure 4A:
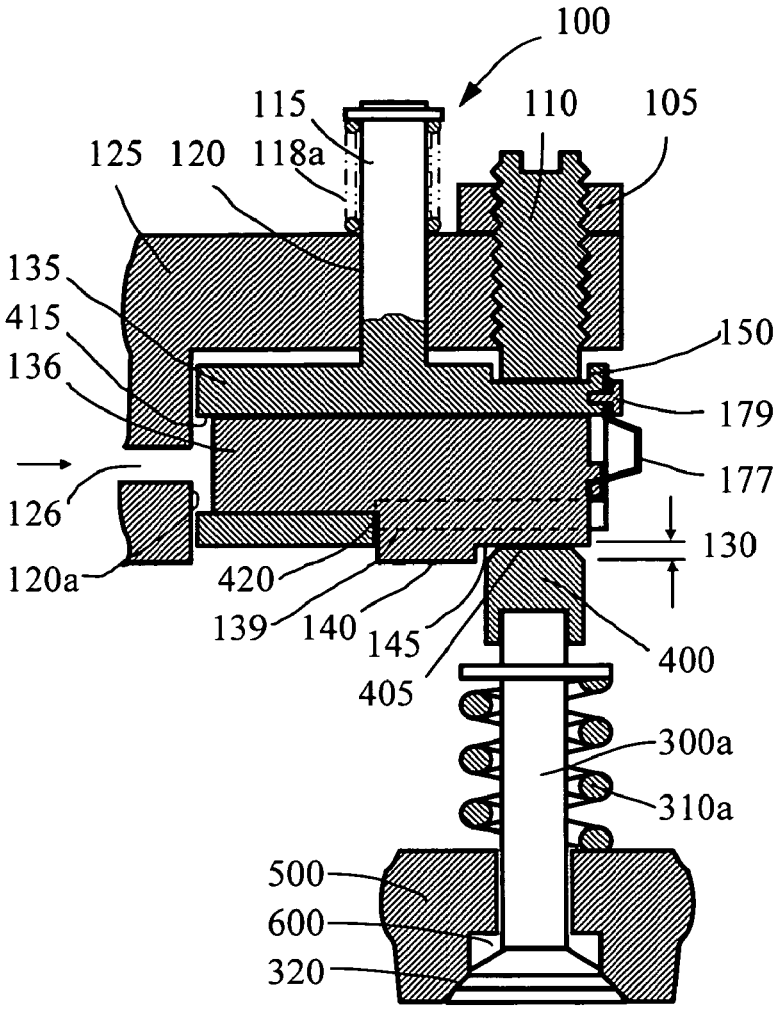
FIG. 4A is a schematic diagram of an engine braking apparatus according to a third embodiment of the present invention.

FIG. 4A is a schematic diagram of an engine braking apparatus according to another embodiment of the present invention, in which the engine brake actuation means 100 contains a slidable device 135*a* that will not rotate but only slide in the bore 120 of the brake housing 125 for the braking valve lash adjustment. The slidable device is biased up by a compression spring 118*a* against the lash adjusting screw 110. In the slidable device 135*a* there is a horizontal bore 415 in which a braking plunger 136 shown with details in FIG. 4B can only slide due to an anti-rotation guide that is formed by two surfaces 136*a* on the braking plunger fitting in a slot 139 cut underneath the bore 415. The braking plunger contains a first surface 140 commensurate with the operative position and a second surface 145 commensurate with the inoperative position. The two surfaces are located on the protrusion portion of the braking plunger and have a height difference 130. The braking plunger 136 is biased inwards to the inoperative position by a flat (or leaf) spring 177. One end of the spring 177 is secured to the slidable device 135*a* by at least one screw 179 and the other end is on the braking plunger surface 136*b* and hooked onto the protrusion 136*c*.

Note that the slidable device 135*a* can have different shapes. If it is a piston, then there will be a bore 120*a* in the brake housing 125 to match the piston, and also an anti-rotation mechanism that is formed by a hole or a radial groove 150 against the lash adjusting screw 110 for preventing the rotation of the slidable device. If it is a rectangular or square block, then 120*a* will be a flat surface. The stem 115 can also take different shapes as long as it can slide up and down in the brake housing for the lash adjustment between the engine brake actuation means and the engine braking valve.

When engine braking is needed, the control means 50 containing the solenoid valve 51*a* (FIG. 3) is turned on. The pressurized engine oil gets into the flow passage 126 in the brake housing 125, overcomes the preload by the spring 177, and pushes the braking plunger 136 out after the exhaust valve 300*a* is pushed down by the exhaust valve lifter 200 (FIG. 4A). There is a motion limiting means that controls the movement of the braking plunger 136. The plunger movement or stroke is defined by the distance between the stop surface 420 at the left end of the slot or undercut 139 and the spring 177 whose stop surface contacts the stop surface 136*d* on the braking plunger. Once the first surface 140 on the braking plunger 136 is over the valve bridge top surface 405, the exhaust valve 300*a* pushed out by the exhaust valve lifter 200 cannot close or return to its seat 320 but is held open to create an engine braking event.

The lash adjusting system for this engine braking apparatus comprises the lash adjusting screw 110, the slidable device 135*a* in the housing 125, and the plunger 136. It is designed for setting a lash between the brake actuation means 100 and the braking valve 300*a*. The height difference 130 between the first surface 140 and the second surface 145 on the plunger minus the braking valve lash determines the braking valve lift for the engine braking event or operation.

Figure 4B:
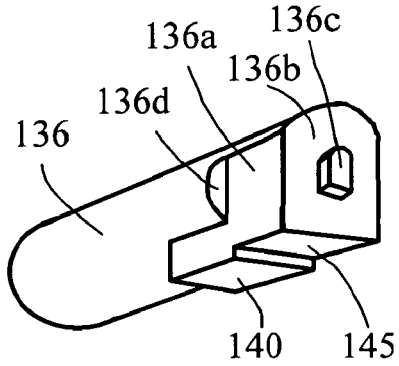
FIG. 4B is a schematic diagram of a slidable plunger contained in the engine braking apparatus shown in FIG. 4A.
Figure 5A:
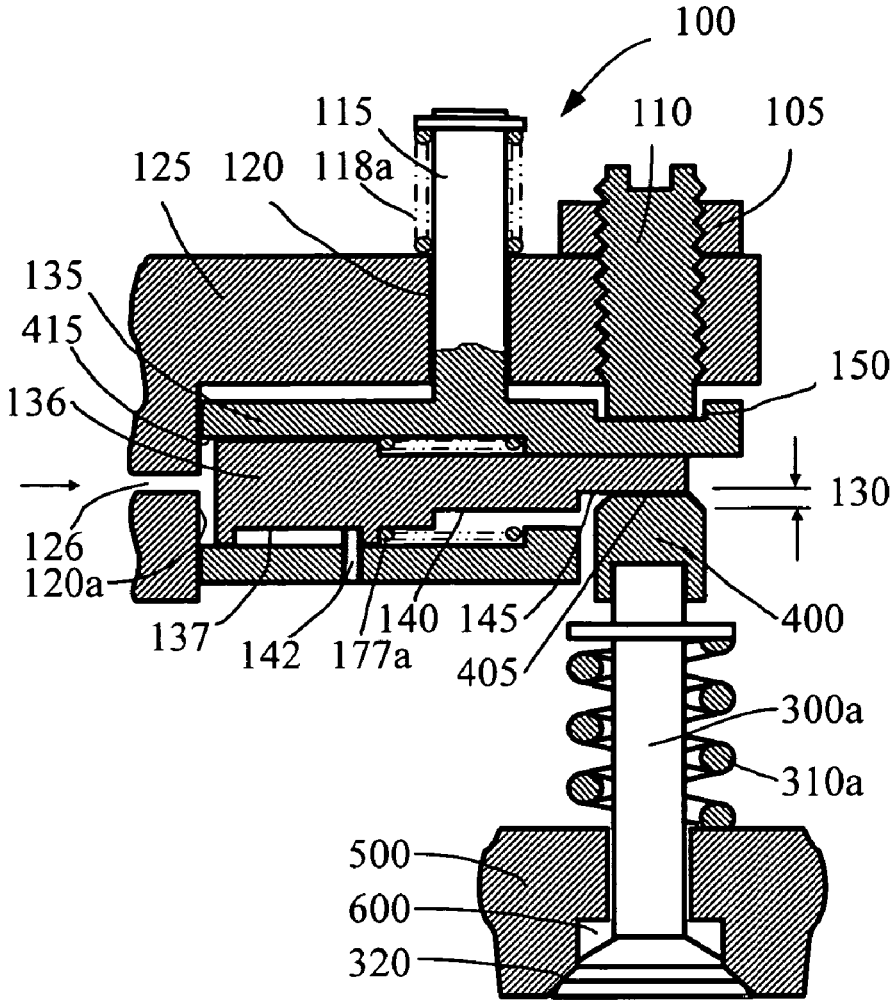
FIG. 5A is a schematic diagram of an engine braking apparatus according to a fourth embodiment of the present invention.
Figure 5B:
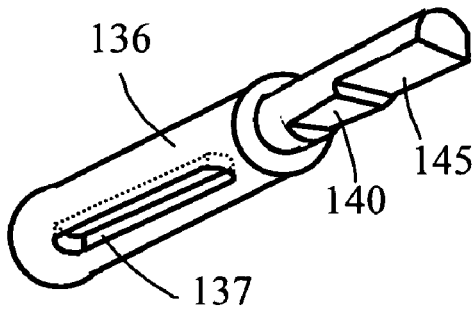
FIG. 5B is a schematic diagram of a slidable plunger contained in the engine braking apparatus shown in FIG. 5A.

FIGS. 5A and 5B show a similar embodiment to that shown in FIGS. 4A and 4B except that the braking plunger 136 is biased to the inoperative position by a compression spring 177*a*. One end of the spring sits on the slidable device 135*a* and the other end on the braking plunger. Another difference is the motion limiting means. A pin 142 on the slidable device fits into an axial groove 137 in the braking plunger for controlling the axial motion of the braking plunger. The pin and groove combination also forms an anti-rotation guide for the braking plunger. Also the operative and inoperative surfaces 140 and 145 are undercuts on the braking plunger as shown in FIG. 5B.

Figure 6:
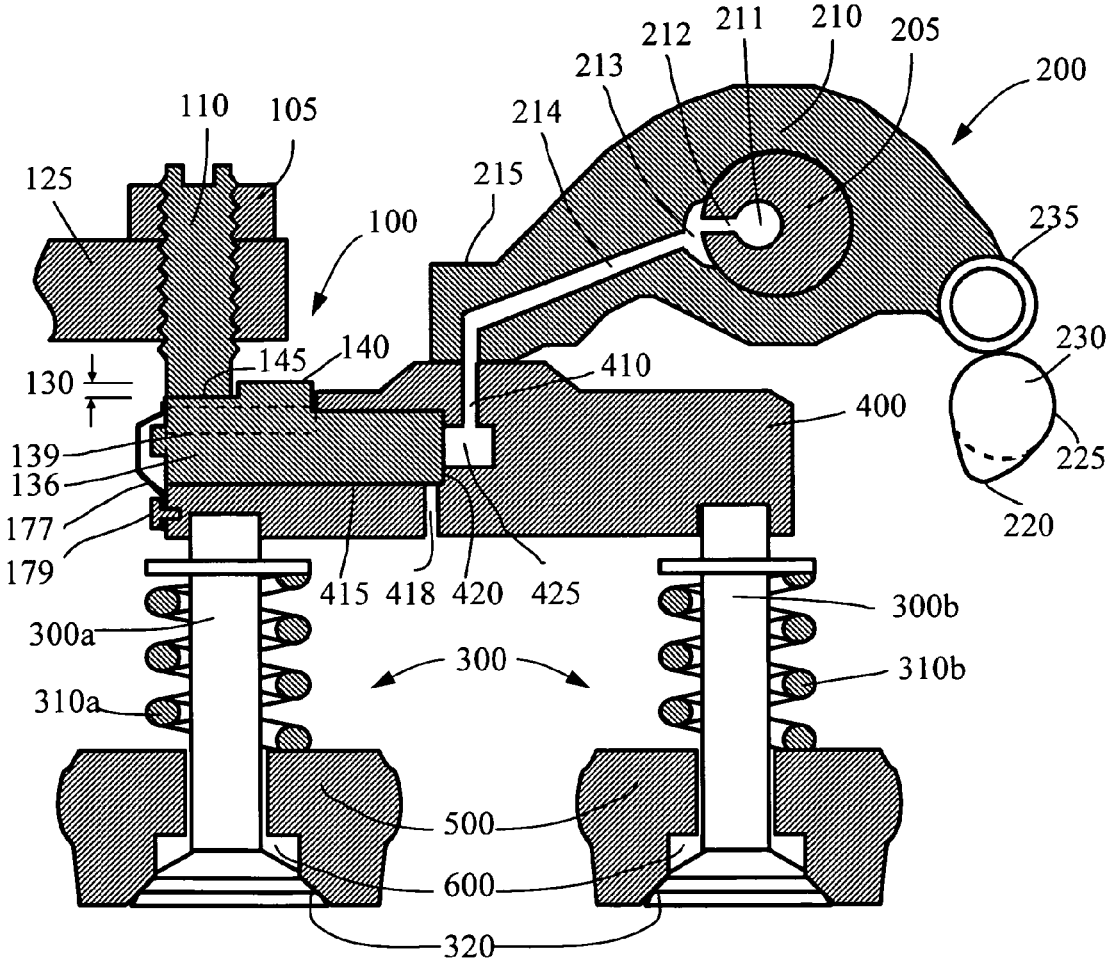
FIG. 6 is a schematic diagram of an engine braking apparatus with an exhaust valve train of the engine according to a fifth embodiment of the present invention.

FIG. 6 shows another embodiment with a slidable device. Here the brake apparatus further comprises the valve bridge 400. A braking plunger 136 as shown in FIG. 4B now is slidably disposed in a bore 415 in the valve bridge 400. The plunger 136 is guided by an anti-rotation guide formed by two surfaces 136*a* (FIG. 4B) on the plunger and a slot 139 that is cut on top of the bore 415. The plunger 136 contains a first surface 140 (the operative position) and a second surface 145 (the inoperative position). Facing upwards to the lash adjusting screw 110, the two surfaces are located on the protrusion portion of the braking plunger 136 and have a height difference 130. The lash adjusting screw is secured to the brake housing 125 by a lock nut 105. The braking plunger 136 is biased inwards to the inoperative position by the spring 177. One end of the spring 177 is secured to the valve bridge 400 by at least one screw 179 and the other end is on the braking plunger surface 136*b* (FIG. 4B).

Figure 7A:
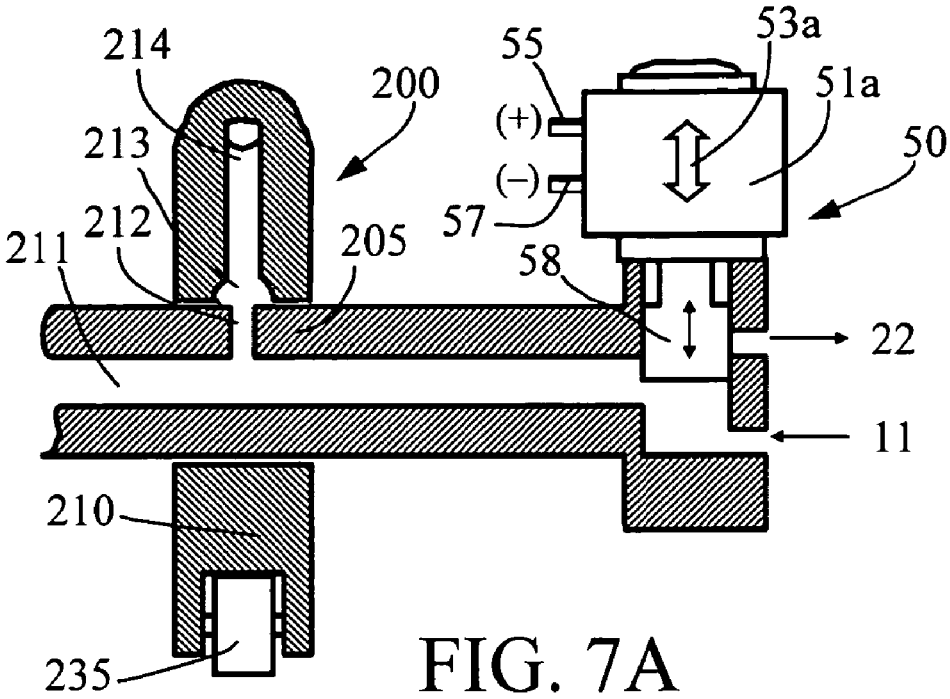
FIGS. 7A and 7B are schematic diagrams of an engine brake control mean at its "on" or "feeding" position and its "off" or "drain" position according to at least one embodiment of the present invention.
Figure 7B:
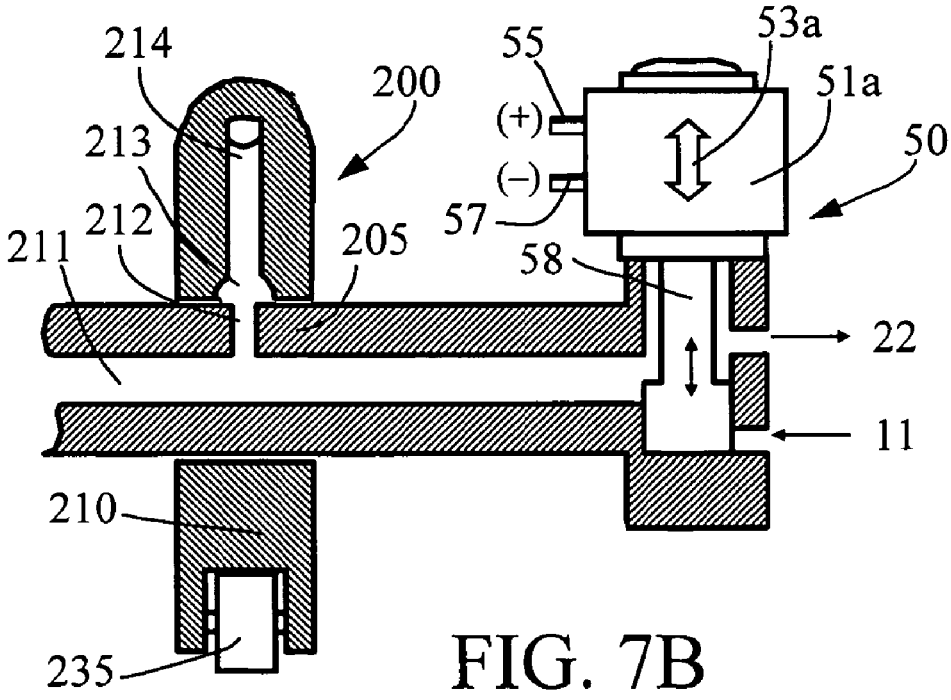

FIGS. 7A and 7B are schematic diagrams of an engine brake control means 50 at its on and off positions. When engine braking is needed, the control means 50 containing a three-way solenoid valve 51*a* is turned on as shown in FIG. 7A, and the port 11 is opened to allow engine oil to a fluid circuit comprising a flow passage 211 in the rocker shaft 205 of the engine. The engine oil flow passes a radial orifice 212, through an undercut 213, and into a flow passage 214 in the rocker arm 210. Note that the control means 50 could be remotely located and used for controlling multiple cylinder engine brakes, and the fluid circuit may reach other components of the engine.

With reference back to FIG. 6, the engine oil flows from the rocker arm 210 to a pressure chamber 425 in the valve bridge 400 through a flow passage 410. The engine oil pressure overcomes the preload of the spring 177, and pushes the braking plunger 136 out after the valve bridge 400 (and the braking valve 300*a*) is pushed away from the adjusting screw 110 by the exhaust valve lifter 200. The movement of the braking plunger 136 is controlled by a motion limiting means with a plunger stroke defined by the distance between the stop surface 420 on the valve bridge 400 and the spring 177 whose stop surface contacts the stop surface 136*d* (FIG. 4B) on the braking plunger 136. Once the operative surface 140 is out and under the adjusting screw 110, the exhaust valve 300*a* pushed out by the exhaust valve lifter 200 cannot close or return to its seat 320 but is held open to create an engine braking event.

The lash adjusting system for this engine braking apparatus (FIG. 6) comprises the lash adjusting screw 110, the valve bridge 400, and the braking plunger 136 slidable in the valve bridge. The height difference 130 between the first surface 140 and the second surface 145 on the plunger minus the braking valve lash determines the braking valve lift for the engine braking event or operation.

When engine braking is not needed, the three-way solenoid valve 51*a* is turned off and the spool 58 will close the oil supply port 11 and open the drain port 22 as shown in FIG. 7B. Without oil pressure acting on the plunger 136, it will be pushed back by the spring system 177. Once the second surface 145 is under the adjust screw as shown in FIG. 6, the engine brake means 100 is at the inoperative position and disengaged from the normal engine operation.

Note that the bleeding orifice 418 in the valve bridge is optional and used for turning off the engine brake faster or even totally eliminating the need of the drain port 22. Therefore, a two-way solenoid valve plus the bleeding orifice 418 may be used to replace the three-way solenoid valve 51*a*. Also a spring may be desirable to bias the rocker arm 210 against the valve bridge for a better sealing of the fluid from the passage 214 in the rocker arm to the passage 410 in the valve bridge.

Figure 8A:
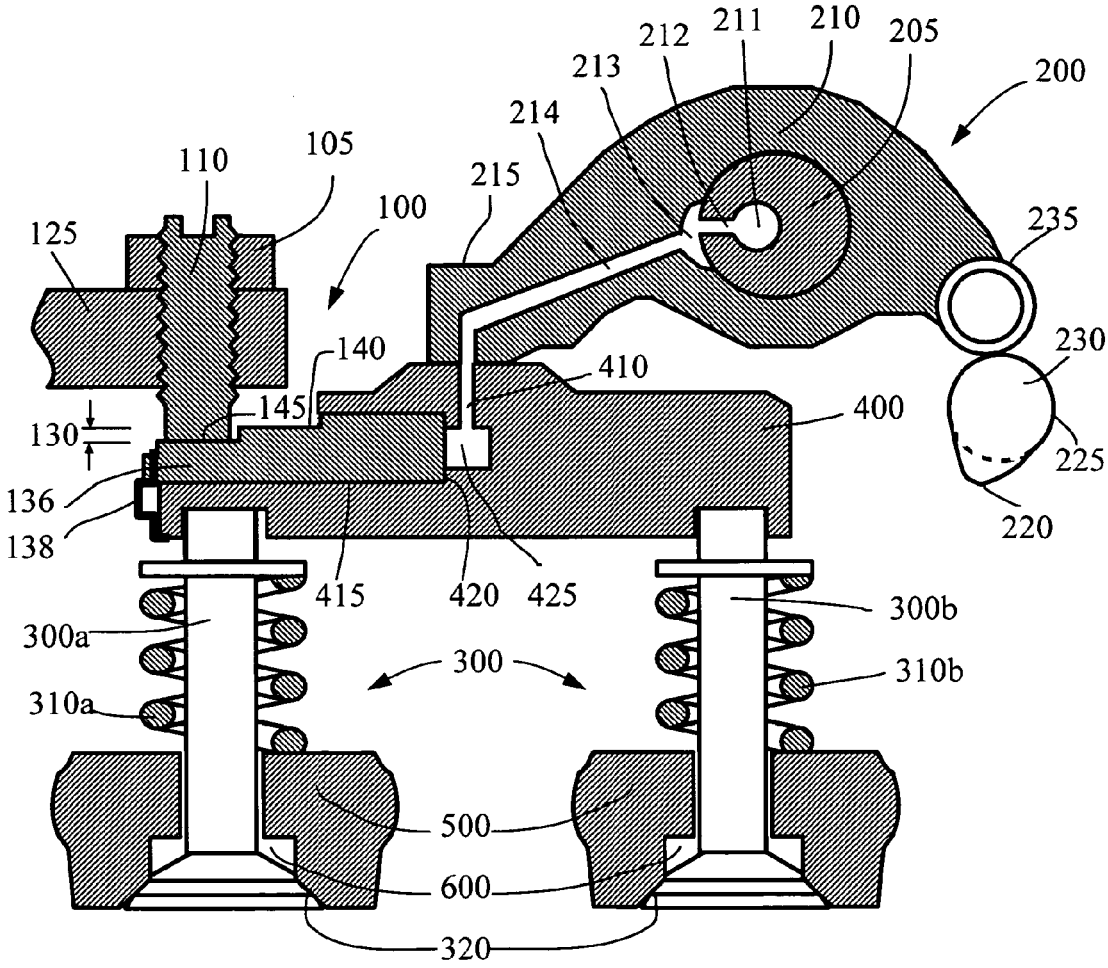
FIG. 8A is a schematic diagram of an engine braking apparatus according to a sixth embodiment of the present invention.
Figure 8B:
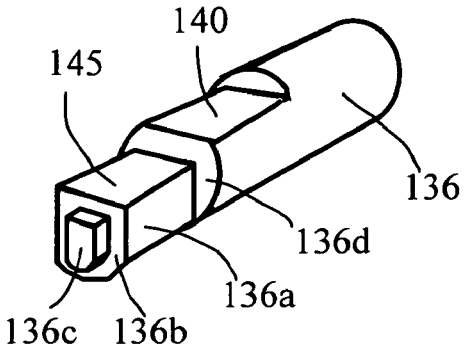
FIG. 8B is a schematic diagram of a slidable plunger contained in the engine braking apparatus shown in FIG. 8A.
Figure 8C:
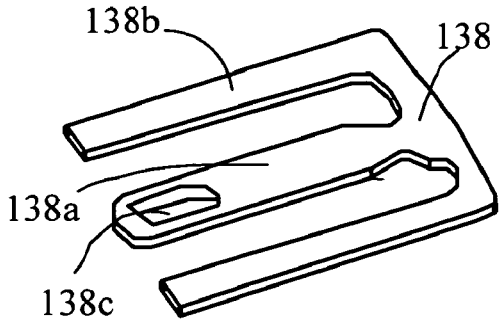
FIGS. 8C and 8D are schematic diagrams of a spring used in the engine braking apparatus shown in FIG. 8A.
Figure 8D:
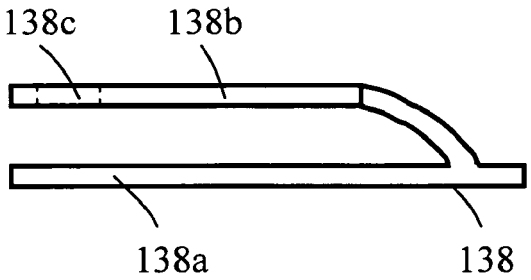
Figure 8E:
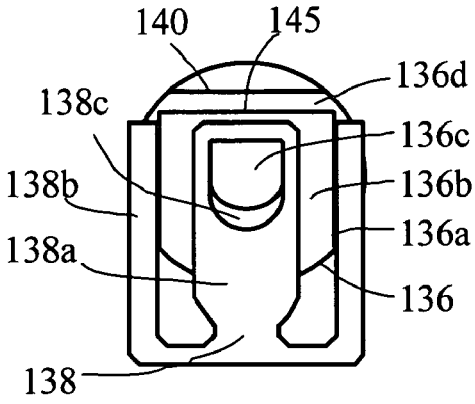
FIG. 8E is a schematic diagram showing the relationship between the spring shown in FIGS. 8C and 8D and the slidable plunger shown in FIG. 8B.

FIG. 8A shows a similar embodiment to that shown in FIG. 6 except that the braking plunger 136 shown with details in FIG. 8B is biased to the inoperative position by a special spring device 138 that also acts as a stop and an anti-rotation guide to the braking plunger as shown in FIGS. 8C, 8D and 8E. Another difference is that the first and second surfaces 140 and 145 are not on the protrusion (FIG. 4B) but undercuts on the braking plunger as shown in FIG. 8B. The bleeding orifice 418 in the valve bridge as shown in FIG. 6 can still be used but is not shown here. Therefore the three-way solenoid valve with the drain port 22 in FIG. 7B is used for turning off the engine brake.

With continued reference to FIGS. 8A and 8B, the braking plunger 136 is slidable in the valve bridge 400 and biased to the inoperative position by a spring 138*a* of the spring device 138 whose details are shown in FIGS. 8C and 8D. There is an anti-rotation guide and the braking plunger with guiding surfaces 136*a* can only slide between the two legs 138*b* of the spring device that are fixed into the valve bridge 400. The spring 138*a* acts on surface 136*b* of the braking plunger. The slot or cut 138*c* in the spring fits onto the protrusion 136*c* on the plunger, which can also acts as a guide to the sliding of the braking plunger as shown in FIG. 8E. A motion limiting means controls the motion of the braking plunger 136. The plunger stroke is defined by the distance between the stop surface 420 on the valve bridge 400 and the spring legs 138*b* that contact the stop surface 136*d* on the braking plunger as shown in FIGS. 8B to 8E.

Figure 9A:
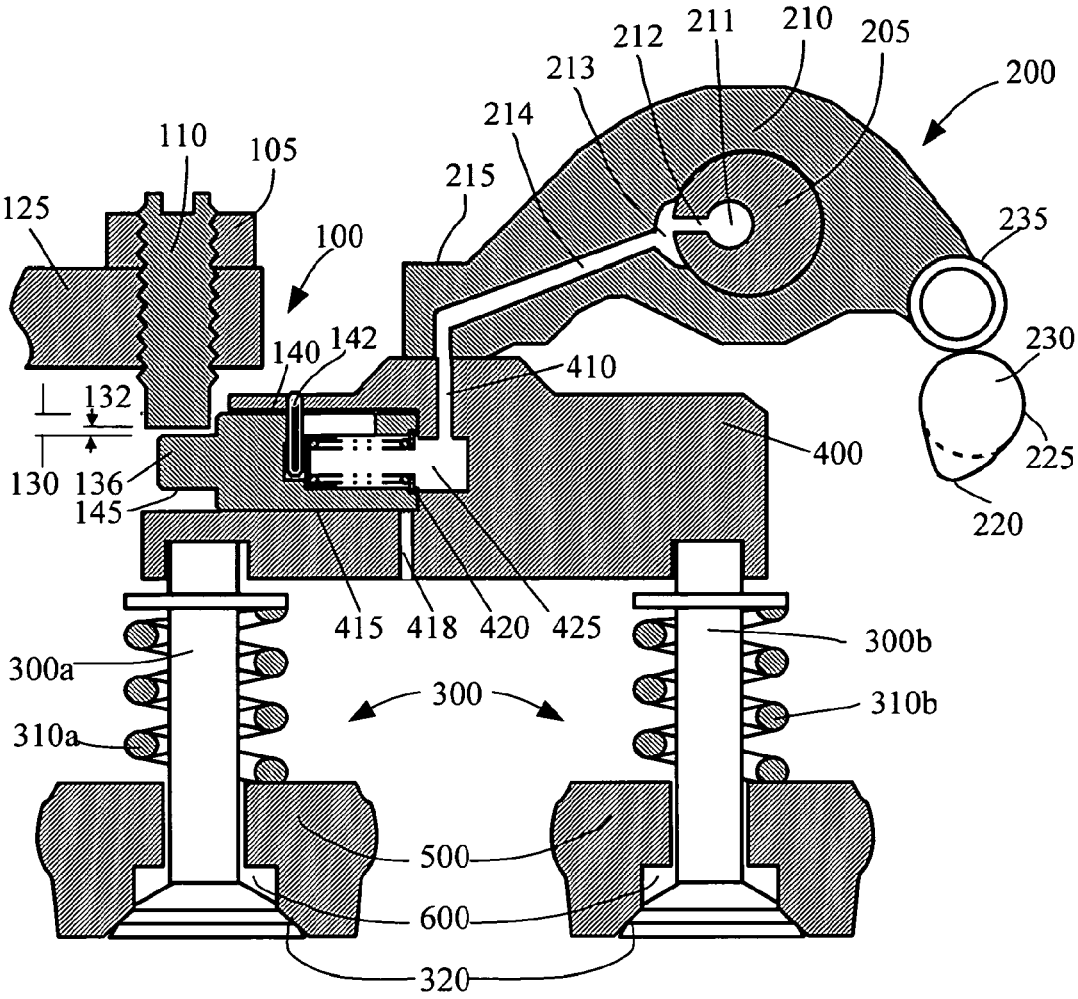
FIG. 9A is a schematic diagram of an engine braking apparatus with an exhaust valve train of the engine according to a seventh embodiment of the present invention.
Figure 9B:
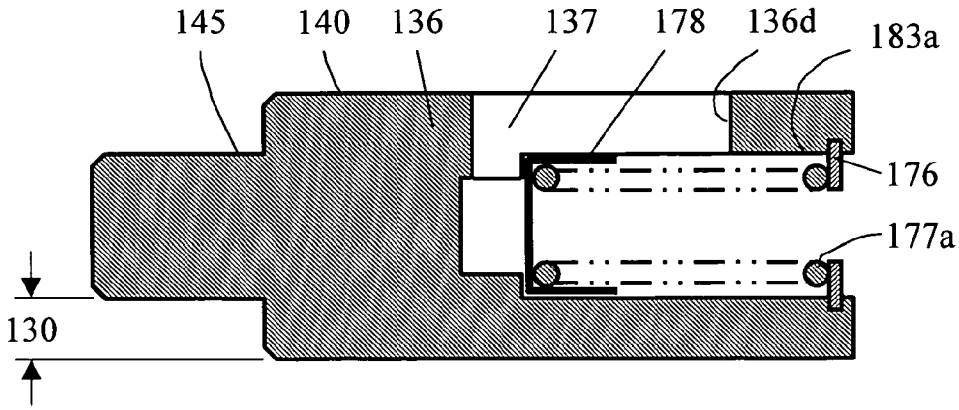
FIG. 9B is a schematic diagram of a slidable plunger assembly contained in the engine braking apparatus shown in FIG. 9A.

FIG. 9A shows another embodiment with the braking plunger 136 shown with details in FIG. 9B sliding in the valve bridge 400. The plunger 136 contains a first surface 140 commensurate with the operative position and a second surface 145 commensurate with the inoperative position. The two surfaces are on two cylindrical surfaces and have a height difference 130 (FIG. 9B). The braking plunger 136 is biased to the inoperative position (FIG. 9A where surface 145 is under lash adjusting screw 110) by a coil spring 177*a*. One end of spring 177*a* sits on a spring seat 176 that is mounted on the braking plunger 136. The other end of the spring sits on another spring seat 178. Seat 178 is slidable in the bore 183*a* but normally is stopped against a pin 142 fixed in the valve bridge 400. There is a slot 137 or axial cut across the bore 183*a* in the braking piston 136, which has a width slightly larger than the pin 142. The pin 142 and the slot 137 can form a motion limiting means to control the movement of the braking plunger 136.

When engine braking is needed, the control means 50 is turned on as shown in FIG. 7A to allow engine oil to flow through the engine braking fluid circuit and into a pressure chamber 425 in the valve bridge 400 through a flow passage 410 (FIG. 9A). The engine oil pressure overcomes the preload of the spring 177*a*, and pushes the braking plunger 136 out of the bore 415 after the valve bridge 400 (and the braking valve 300*a*) is pushed away from the adjusting screw 110 by the exhaust valve lifter 200. When the surface 136*d* in the slot 137 hits the pin 142, the braking plunger 136 will stop moving. Now the braking plunger 136 is fully out or extended and the operative surface 140 is under the adjusting screw 110, the exhaust valve 300*a* pushed out by the exhaust valve lifter 200 cannot close or return to its seat 320 but is held open to create an engine braking event.

The lash adjusting system for this engine braking apparatus (FIG. 9A) comprises the lash adjusting screw 110, the valve bridge 400, and the braking plunger 136 slidable in the valve bridge. The height difference 130 between the first surface 140 and the second surface 145 on the plunger (FIG. 9B) minus the braking valve lash 132 (FIG. 9A) determines the braking valve lift for the engine braking event or operation.

When engine braking is not needed, the control means 50 is turned off and there will be no or little oil supplied to the engine braking fluid circuit. The oil pressure will not be high enough and plunger 136 will be pushed back into the valve bridge 400 by the spring 177*a*. Once the second surface 145 is under the lash adjusting screw 110 as shown in FIG. 9A, the engine brake means 100 is at the inoperative position and disengaged from the normal engine operation. Again, the bleeding orifice 418 in the valve bridge is optional and used for turning off the engine brake.

Figure 10:
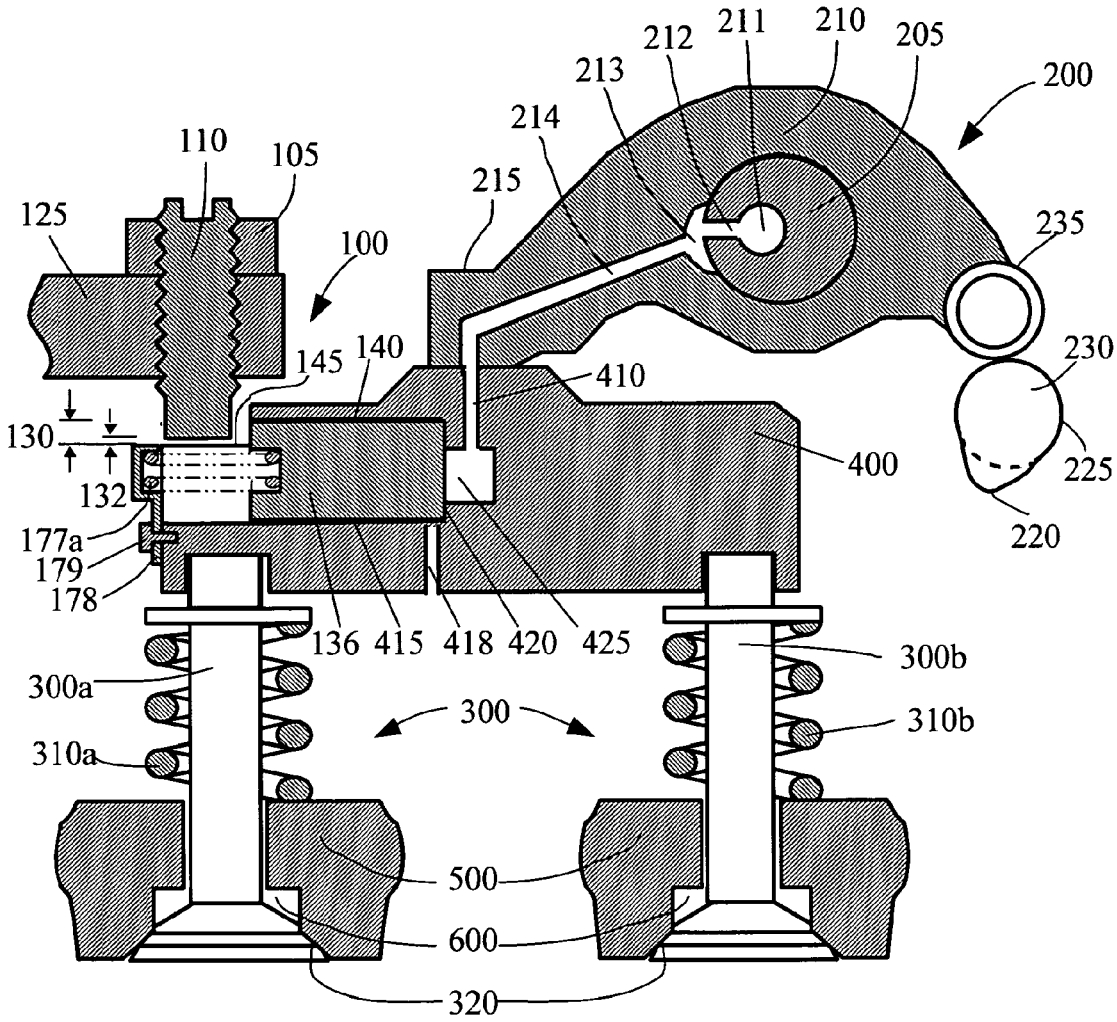
FIG. 10 is a schematic diagram of an engine braking apparatus with an exhaust valve train of the engine according to an eighth embodiment of the present invention.

FIG. 10 shows yet another embodiment with the braking plunger 136 slidably disposed in the valve bridge 400. However, the plunger 136 only contains the first surface 140 commensurate with the operative position, while the second surface 145 commensurate with the inoperative position is on the valve bridge 400 and separated from the lash adjusting screw 110 by a lash 132. The two surfaces 140 and 145 have a height difference 130. The braking plunger 136 is biased to the inoperative position by a coil spring 177*a*. One end of spring 177*a* is on the braking plunger 136 and the other end on a spring seat 178 that is secured on the valve bridge 400 by at least one screw 179. Seat 178 is also used as a stop to the braking plunger 136, which limits the movement of the braking plunger 136.

When engine braking is needed, the control means 50 is turned on (FIG. 7A) to allow engine oil to flow through the engine braking fluid circuit and into a pressure chamber 425 in the valve bridge 400 as shown in FIG. 10. The engine oil pressure overcomes the preload of the spring 177*a*, and pushes the braking plunger 136 out of the bore 415 after the valve bridge 400 (and the braking valve 300*a*) is pushed away from the adjusting screw 110 by the exhaust valve lifter 200. The braking plunger 136 is stopped at the spring seat 178 and fully out or extended. The operative surface 140 is now under the adjusting screw 110, and the exhaust valve 300*a* pushed out by the exhaust valve lifter 200 cannot close or return to its seat 320 but is held open to create an engine braking event.

The lash adjusting system for this engine braking apparatus (FIG. 10) comprises the lash adjusting screw 110 and the valve bridge 400 that contains the braking plunger 136. The height difference 130 between the first surface 140 and the second surface 145 minus the braking valve lash 132 determines the braking valve lift for the engine braking event or operation. Instead of a cylindrical surface as shown in FIG.

10, the first surface 140 can be a flat surface on the braking plunger 136 as shown in FIG. 8A.

When engine braking is not needed, the control means 50 is turned off and there will be no or little oil supplied to the engine braking fluid circuit. The oil pressure will not be high enough and the plunger 136 will be pushed back into the valve bridge 400 by the spring 177*a*. The engine brake means 100 now is at the inoperative position and disengaged from the normal engine operation.

Figure 11A:
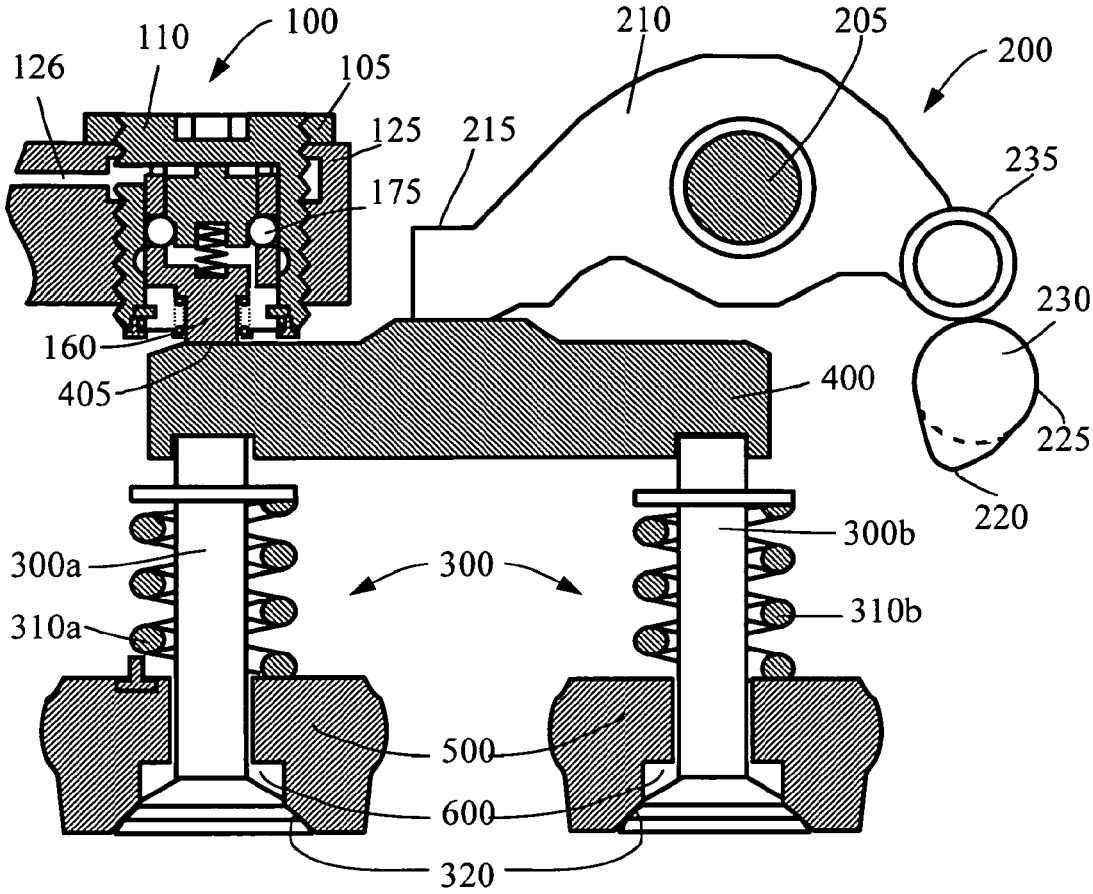
FIGS. 11A and 11B are schematic diagrams of an engine brake actuation means at its "off" and "on" position for an engine braking apparatus according to a ninth embodiment of the present invention.

FIG. 11A shows a different embodiment of the engine brake actuation means 100. It is a ball-locking device over the top surface 405 of the valve bridge 400. The ball-locking device is contained in a lash adjusting system with the lash adjusting screw 110 secured to the brake housing 125 by a lock nut 105. Depending on the position of the ball-locking device, a braking piston 160 can extend or retract to generate the operative position or inoperative position commensurate with the engine braking operation or the normal engine operation.

Figure 11B:
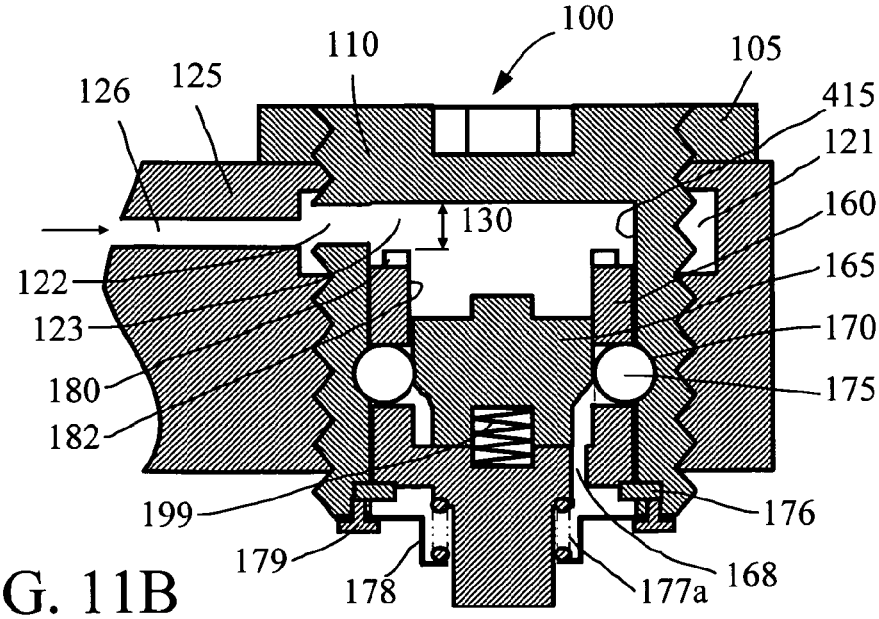

When engine braking is needed, the three-way solenoid valve 51*a* (FIG. 3) is turned on and the port 11 will be open to allow engine oil into the fluid circuit comprising a flow passage 126 in the brake housing 125. The engine oil flows into a chamber 123 through an annular groove 121, one or more orifices 122 and flow passage 180 as shown in FIG. 11B. The oil pressure pushes the braking piston 160 downwards with the ball-locking piston 165 against a spring 177*a*. The spring is supported by a spring seat 178 that is secured to the lash adjusting screw by screws 179. The braking piston 160 will slide in a bore 415 and stop at a clip ring 176 when a plurality of balls 175 contained in holes in the braking piston are aligned with an annular groove 170 in the bore 415. The oil pressure overcomes the preload of spring 199 and pushes the ball-locking piston 165 down to the bottom of the bore 182 in the braking piston, which locks the balls in the groove 170. Now the braking piston 160 is at its extended position with a lift 130, and the exhaust valve 300*a* pushed out by the exhaust valve lifter 200 (FIG. 11A) cannot close or return to its seat 320 but is held open by the braking piston 160 to create an engine braking event. The engine braking load from the braking piston is passed to the lash adjusting screw 110 through the balls 175. Note that the bleeding orifice 168 is designed to drain the oil leaked to the backside of the ball-locking piston to avoid hydraulic lock.

The lash adjusting system for this engine braking apparatus comprises the lash adjusting screw 110, the ball-locking system contained in the lash adjusting screw, and the valve bridge 400. The height difference 130 between the retracted position and the extended position of the ball-locking device minus the braking valve lash determines the braking valve lift for the engine braking event or operation.

When engine braking is not needed, the solenoid valve 51*a* is turned off and the spool 58 will close the oil supply port 11 and open the drain port 22 as shown in FIG. 3. Without oil pressure acting on the ball-locking piston 165, it will be pushed upwards by the spring 199 and the balls forced into the recess or annular cut of the ball-locking piston 165 under the upward push of the braking piston 160 by the spring 177*a*. Once the balls are out of the annular groove 170 in the bore 415, the braking piston 160 is free to move up and back to its retracted position when the engine brake actuation means 100 is disengaged from the engine operation, as shown in FIG. 11A.

Figure 12A:
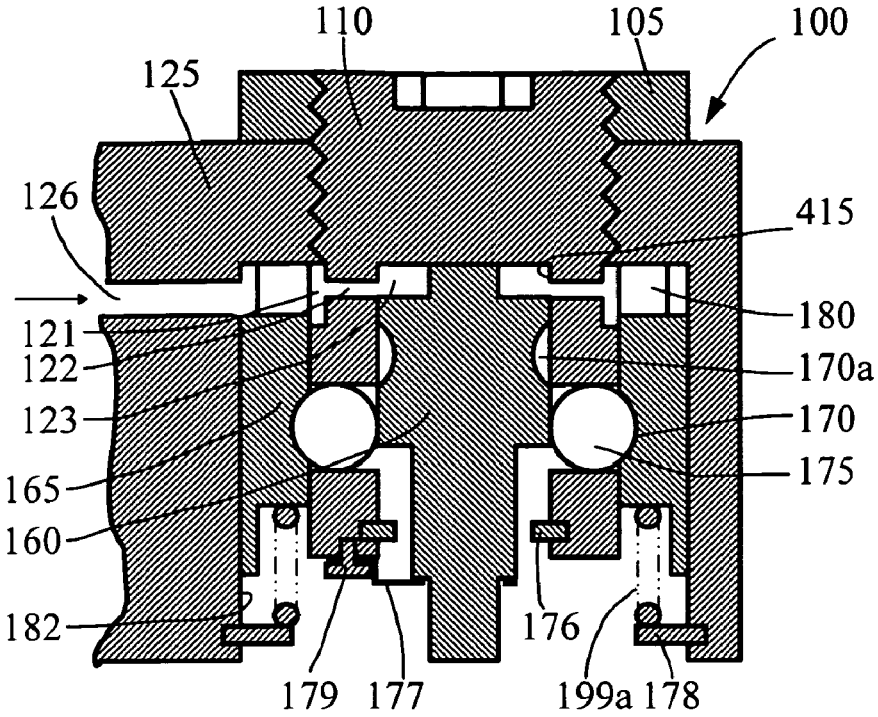
FIGS. 12A and 12B are schematic diagrams of an engine brake actuation means at its "off" and "on" position for an engine braking apparatus according to a tenth embodiment of the present invention.
Figure 12B:
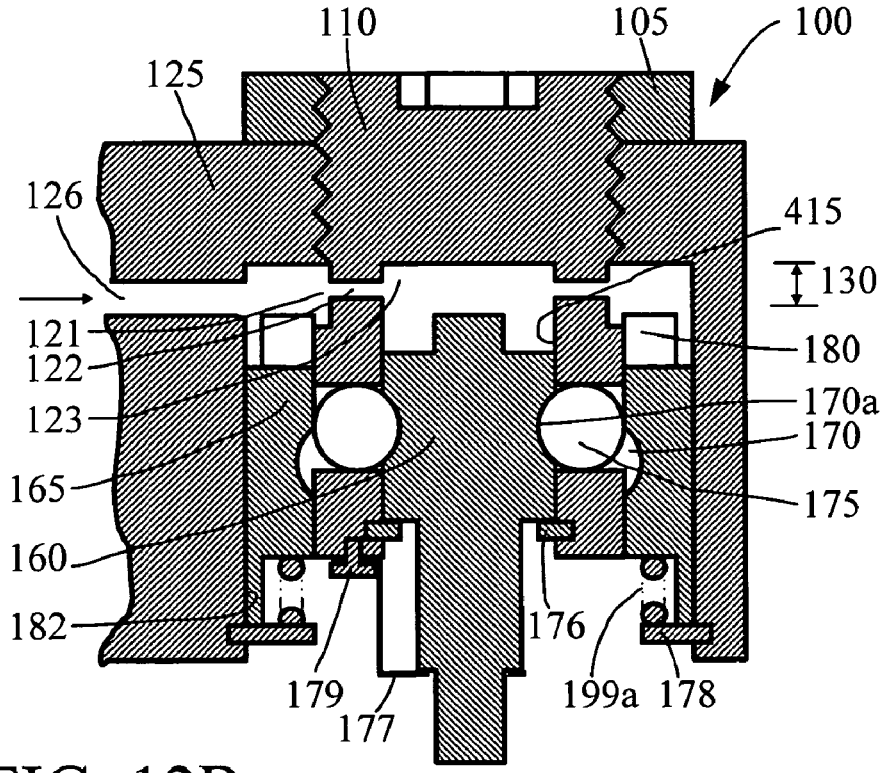

FIGS. 12A and 12B show a similar embodiment to that shown in FIGS. 11A and 11B except that the balls 175 of the ball-locking device are contained in holes in the lash adjusting screw 110 and the ball-locking piston 165 is at the outside of the lash adjusting screw. When engine brake actuation means 100 is at its inoperative position, the braking piston 160 is biased up by the spring 177 or the returning braking valve 300*a* and retracted in the bore 415 as shown in FIG. 12A. Note that the braking piston is part of the lash adjusting system, and the motion limiting means is formed by the ball-locking means.

When engine brake is needed, the engine brake control means 50 (FIG. 3) is turned on and oil pressure pushes the braking piston 160 down against the spring 177 to a stop 176 so that the balls are aligned with an annular groove 170*a* on the braking piston. Now the ball-locking piston 165 can be pushed down by the oil pressure against a spring 199*a* and lock the balls into the groove 170*a* as shown in FIG. 12B. The braking piston 160 is now at its extended position with a lift 130, and the exhaust valve 300*a* pushed out by the exhaust valve lifter 200 (FIG. 12A) cannot close or return to its seat 320 but is held open by the braking piston 160 to create an engine braking event. The engine braking load from the braking piston 160 is passed to the lash adjusting screw 110 through the balls 175.

When engine braking is not needed, the engine brake control means 50 (FIG. 3) is turned off and there will be no oil pressure acting on the ball-locking piston 165, which will be pushed upwards by the spring 199*a* toward the top of the bore 182. Once the annular groove 170 on the ball-locking piston 165 is aligned with the balls 175 in the adjusting screw holes, they will move out of the annular groove 170*a* and the braking piston 160 is free to be moved up in the bore 415 by the spring 177 and the upward valve motion. The braking piston 160 is now back to the retracted position and the actuation means 100 is disengaged from the engine operation, as shown in FIG. 12A.

Figure 13A:
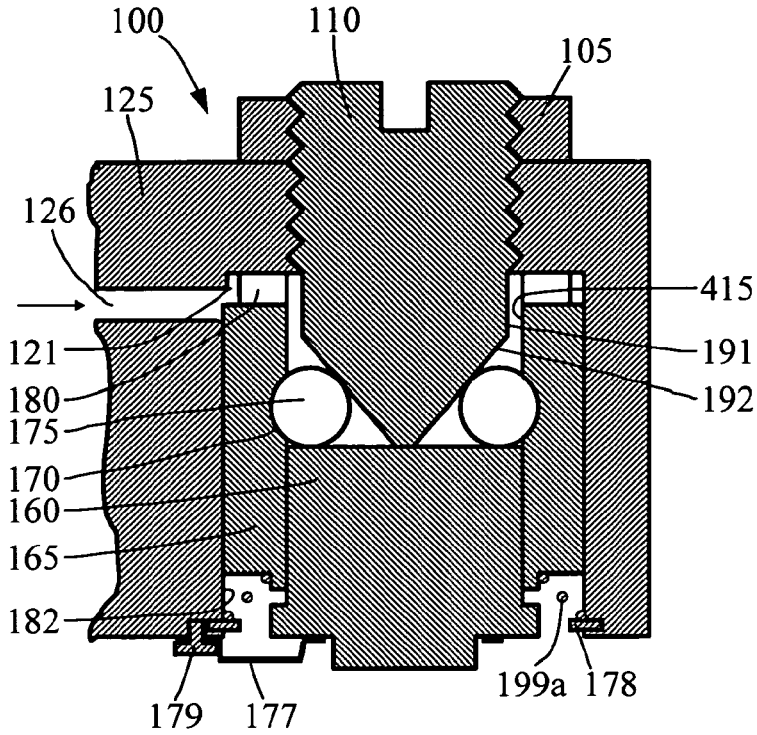
FIGS. 13A and 13B are schematic diagrams of an engine brake actuation means at its "off" and "on" position for an engine braking apparatus according to an eleventh embodiment of the present invention.
Figure 13B:
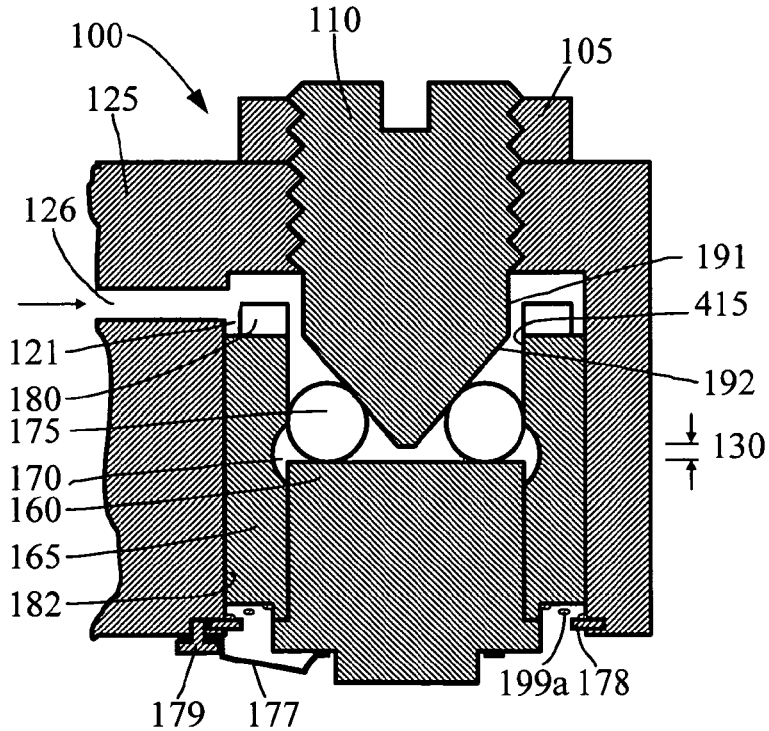

FIGS. 13A and 13B show another ball-locking device with the balls 175 not contained in holes as in the previous embodiments but restrained by three elements or surfaces. The first surface is the tapered surface 192 on the bottom of the adjusting screw 110. The second surface is the flat surface on the top of the braking piston 160. The third surface is on the ball-locking piston 165, either on the annular groove 170 when the ball-locking device is at the retracted position as shown in FIG. 13A or on the bore 415 when the ball-locking device is at the extended position as shown in FIG. 13B. Note that the braking piston 160 is also part of the motion limiting means incorporated into the ball-locking device.

When engine brake is needed, the control means 50 (FIG. 3) is turned on and oil pressure pushes down both the ball-locking piston 165 and the braking piston 160, while the balls 175 move down and inwards along the tapered surface 192. Note that the adjusting screw stem 191 is smaller than the braking piston 160 that slides in the bore 415 inside the ball-locking piston. Once the balls are out of the annular groove 170 in the bore 415, the ball-locking piston can move down further. The total travel of the system is limited by the spring 177 that acts as a spring and a stop. Now the braking piston is at its extended position and locked with the lift 130 as shown in FIG. 13B, which is finalized by the upward push of the returning braking valve 300*a*. The engine braking load is passed from the braking piston 160 to the lash adjusting screw 110 through the balls 175.

The lash adjusting system for the engine braking apparatus comprises the lash adjusting screw 110, the ball-locking system in the housing, and the valve bridge 400 (FIG. 11A). The height difference 130 between the retracted position and the extended position of the ball-locking device minus the braking valve lash determines the braking valve lift for the engine braking event or operation.

When engine braking is not needed, the control means 50 (FIG. 3) is turned off and there will be no oil pressure acting on the ball-locking piston 165, which will be pushed upwards by the spring 199*a* towards the top of the bore 182. The balls are now aligned with and forced into the annular groove 170 in the ball-locking piston 165 and the braking piston 160 can be pushed up by the spring 177 or the returning braking valve 300*a* and back to its retracted position as shown in FIG. 13A.

Figure 14A:
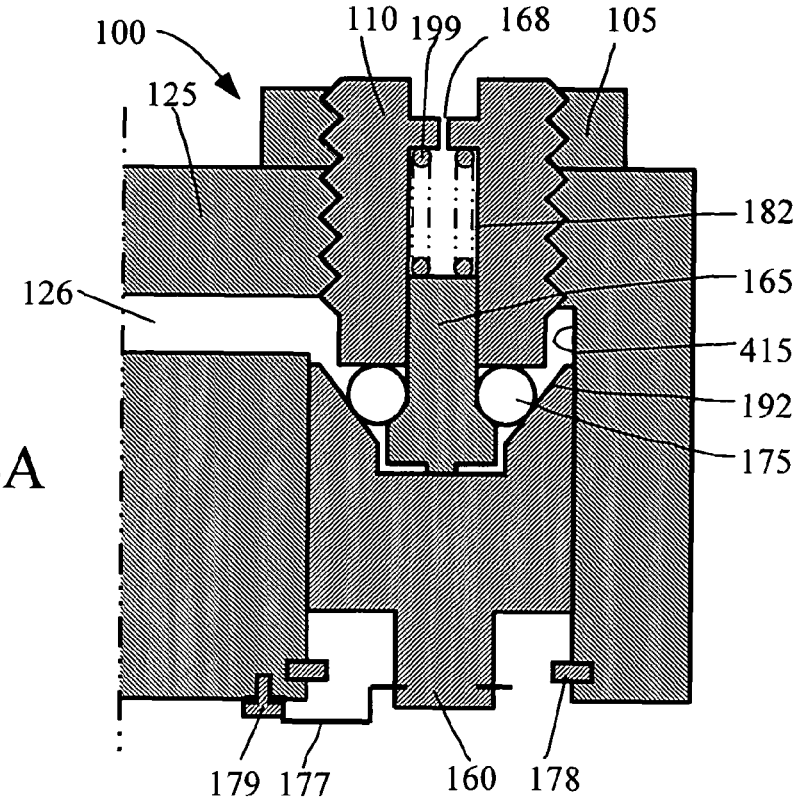
FIGS. 14A and 14B are schematic diagrams of engine brake actuation means at its "off" and "on" position for an engine braking apparatus according to an twelfth embodiment of the present invention.
Figure 14B:
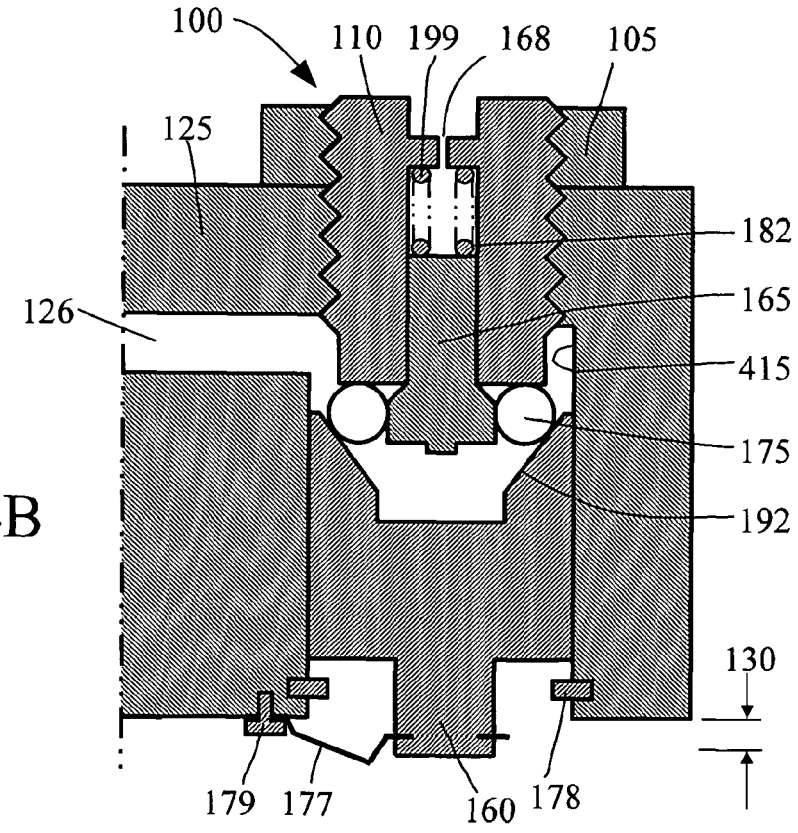

FIGS. 14A and 14B show another ball-locking device with balls 175 restrained by three elements or surfaces. The first surface is the tapered surface 192 on the braking piston 160. The second surface is the bottom flat surface on the lash adjusting screw 110 and the third surface on the ball-locking piston 165 that slides in a bore 182 in the adjusting screw. Again, the braking piston 160 is part of the lash adjusting system and the motion limiting means is incorporated into the ball-locking device.

When engine brake is needed, the control means 50 (FIG. 3) is turned on and oil pressure pushes down the braking piston 160 to a stop 178, while the balls 175 move outward along the tapered surface 192. Due to the oil pressure on the ball-locking piston 165, it is pushed upward against the spring 199. The venting orifice 168 on top of the adjusting screw 110 is designed to eliminate hydraulic lock of the ball-locking piston 165. The tapered surface 192 and balls 175 are so designed that when the braking piston 160 is at its extended position, the ball-locking piston 165 is at the highest position and its large diameter surface locks the balls into a position shown in FIG. 14B. The height difference 130 between the retracted position and the extended position of the ball-locking device minus the braking valve lash determines the braking valve lift for the engine braking event or operation. The engine braking load is passed from the braking piston 160 to the lash adjusting screw 110 through the balls 175.

When engine braking is not needed, the control means 50 (FIG. 3) is turned off and there will be no oil pressure acting on the ball-locking piston 165, which will be pushed downward by the spring 199 so that the balls 175 can move inward. The braking piston 160 can now slide upward in the bore 415 under the push of spring 177 or the returning braking valve 300*a*. Note that the force by spring 177 on the braking piston 160 is higher than that by spring 199 on the ball-locking piston 165 so that the ball-locking device could be back to its retracted position as shown in FIG. 14A.

Figure 15A:
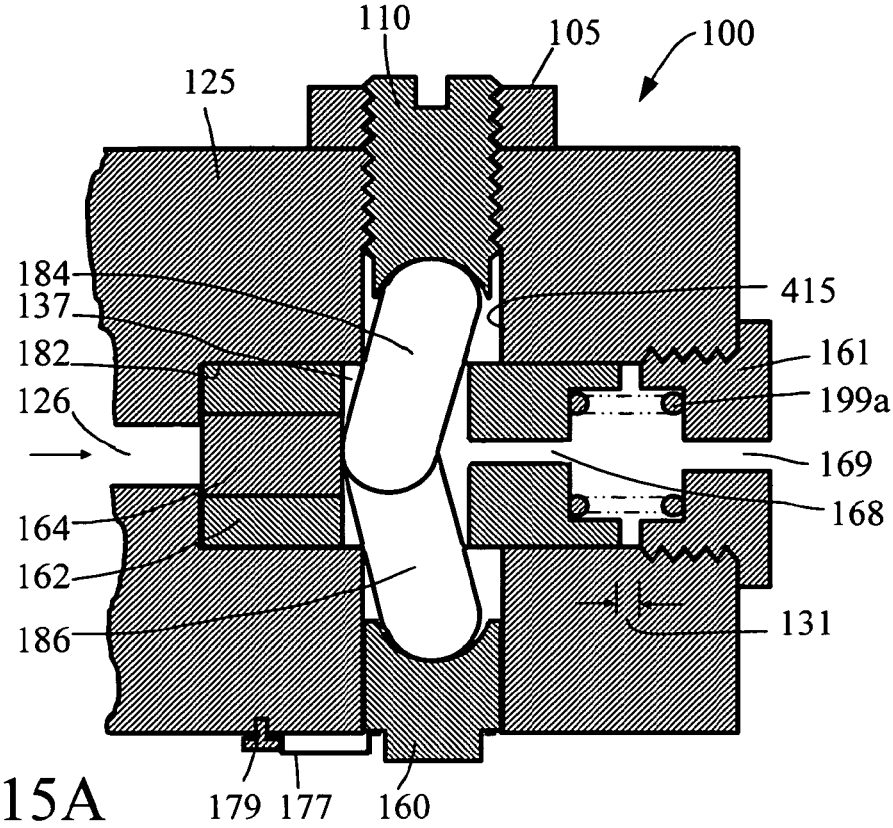
FIGS. 15A and 15B are schematic diagrams of engine brake actuation means at its "off" and "on" position for an engine braking apparatus according to an thirteenth embodiment of the present invention.
Figure 15B:
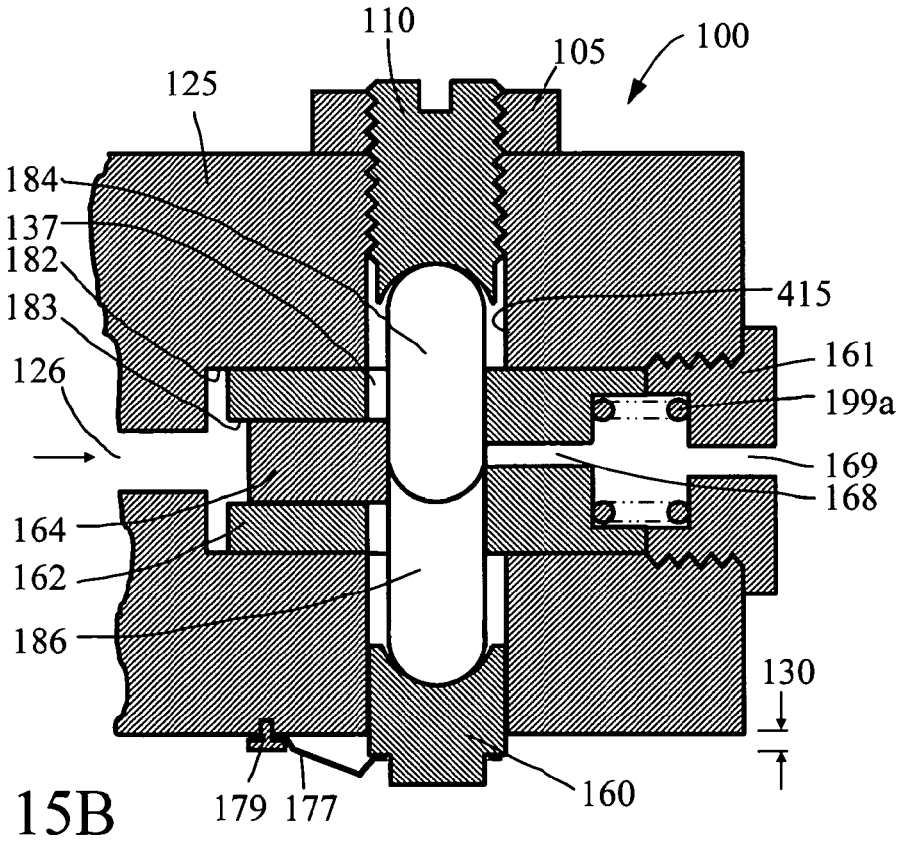

FIGS. 15A and 15B show a different embodiment of the engine brake actuation means 100. It is a toggle device that contains two pins 184 and 186, and a braking piston 160 that slides in a vertical bore 415 in the brake housing 125. The upper pin 184 has two spherical ends; one engaged with a socket in the adjusting screw 110, and the other with another socket in the lower pin 186 whose lower end sits in a third socket in the braking piston 160. FIG. 15A shows the retracted position of the toggle device where the two pins guided in the slot 137 that is cut through a pin-locking piston 162 are pushed to the left by the spring 199*a*. The pin-locking piston 162 slides in a horizontal bore 182 in the braking housing 125. There is a smaller pin-locking piston 164 that slides in the larger pin-locking piston 162. The slot 137 in piston 162 has a width that matches the diameter of the two pins and a length that is smaller than the diameter of the bore 415. There will be always contact (no separation) among the braking piston, the lower pin, the upper pin, and the adjusting screw due to the upward force of the spring 177 that is secured to the brake housing 125 with at least one screw 179.

When engine brake is needed, the control means 50 (FIG. 3) is turned on and oil pressure can push both pin-locking pistons 162 and 164 to the right against the preload of the spring 199*a*. Note that the small pin-locking piston 164 can be moved to the right further to lock the two pins in a vertical position, aligned with the adjusting screw and the braking piston, as shown in FIG. 15B. Now the toggle device is locked to its extended position. The motion limiting means for this toggle device is unique. The angle between the two pins decides the height difference 130, while the angle itself is controlled by the two pin-locking pistons. The pin-locking piston 162 has a stroke 131. The two bleeding orifices 168 and 169 are designed to eliminate hydraulic lock so that the two pistons can move freely. The orifice 169 is in a mounting screw 161 that acts as a spring seat and a stop to the large pin-locking piston 162.

Again, a bleeding orifice could be added to the flow passage 126 in the engine braking fluid circuit for turning off the engine brake faster or even totally eliminating the need of the drain port 22 (FIG. 3), so that a two-way solenoid valve plus the bleeding orifice may be used to replace the three-way solenoid valve 51*a*.

The lash adjusting system is incorporated into the toggle device. The height difference 130 between the retracted position and the extended position of the toggle device minus the braking valve lash determines the braking valve lift for the engine braking event or operation. The engine braking load is passed from the braking piston 160 to the lash adjusting screw 110 through the two pins 184 and 186.

CONCLUSION, RAMIFICATIONS, AND SCOPE

It is clear from the above description that the engine braking apparatus according to the embodiments of the present invention have one or more of the following advantages over the prior art engine braking systems:

(a) The system can be installed on all types of engines;
(b) The system can be retrofitted to existing engines;
(c) The engine braking load is not carried by the engine (valve train) components;
(d) The system has no need for redesign of the engine or engine components;
(e) The system has fewer components, reduced complexity, and lower cost;
(f) The system has a braking valve lash adjusting system;
(g) The system is more rugged and simple in construction, easier to install, more reliable in operation, and effective at all engine speeds; and
(h) The system transmits force, or the engine braking load, through mechanical linkage means that does not have high compliance and overloading problems associated with hydraulic means used by some of the prior art engine brakes.

Due to the above advantages, the engine braking apparatus disclosed here can be used not only on truck engines, but also personal car engines; not only to slow down vehicles, but also to enhance vehicle cruise control, braking gas or exhaust gas recirculation control, and other engine or vehicle controls.

While my above description contains many specificities, these should not be construed as limitations on the scope of the invention, but rather as an exemplification of the preferred embodiments thereof. Many other variations are possible. For example, instead of sitting over the top surface 405 of the valve bridge 400 for opening one exhaust valve 300*a* for engine braking as shown in FIG. 2 and other figures, the engine brake actuation means 100 can sit over the top surface 215 of the rocker arm 210 or under the bottom surface of the rocker arm 210 on the cam follower 235 side for opening two exhaust valves 300 (300*a* and 300*b*) for engine braking. The top surfaces could have different shape other than flat surface, for example, a spherical shape.

Also, instead of one plunger 136 in one side of the valve bridge 400 for opening one exhaust valve 300*a* for engine braking as shown in FIG. 6 and other figures, two plungers 136 can be put in both sides of the valve bridge 400 for opening two exhaust valves 300 (300*a* and 300*b*) for engine braking.

Also, the engine braking apparatus disclosed here can be applied to a push tube type engine (not shown here) instead the overhead cam type engine as shown in FIG. 2 and other figures, as well as to the engine's intake valve system (not shown here) instead the exhaust valve system.

Also, the engine brake actuation means 100 can be controlled (turned on and off) by other types of control means 50, like a simple mechanical means, such as the wire control mechanism for a bicycle brake control. And a poppet type control valve could be used to replace the spool type valve 51*a* of the control means 50 as shown in FIG. 3.

Also, the two surfaces 140 and 145 commensurate with the operative and inoperative positions of the engine brake actuation means 100 as shown in FIG. 2 and other figures can be combined as one tapered or sloped surface, for example, a wedge type mechanism. And the tapered surface could be actively controlled to generated variable braking valve lift, which could be very useful for different engine braking needs, for example, at different engine speeds.

Also, the housing 125 can be different. It can be a rocker arm mounted on a rocker shaft; and there can be a different cam that has more than one lobe.

Further, two levels of oil supply pressure could be provided to the fluid circuit as shown in FIG. 6 so that during engine braking, the oil with full supply pressure flows into the braking circuit to actuate the engine braking actuation means 100, while during the normal engine operation, the oil flowing through a pressure reduction device, for example, an orifice, into the braking fluid circuit does not have high enough pressure to actuate the actuation means 100 but can be used for system lubrication.

Accordingly, the scope of the invention should be determined not by the embodiments illustrated, but by the appended claims and their legal equivalents.

I claim:

1. Apparatus for modifying engine valve lift to produce an engine valve event in an internal combustion engine, the engine including at least one exhaust valve and an exhaust valve lifter for cyclically opening and closing the at least one exhaust valve, said apparatus comprising:

(a) an actuator for operating the at least one exhaust valve to produce said modified engine valve lift, said actuator having an inoperative position and an operative position; in said inoperative position said actuator being disengaged from the operation of the at least one exhaust valve, and in said operative position said actuator opening the at least one exhaust valve for said engine valve event; said actuator comprising a mechanical linkage for transmitting a load generated by said engine valve event, said actuator further comprising a lash adjusting system for setting a lash between said actuator and the at least one exhaust valve, and (b) a controller for moving said actuator between said inoperative position and said operative position.

2. The apparatus of claim 1, wherein said engine valve event comprises an engine braking event.

3. The apparatus of claim 1, wherein said actuator further comprises a motion limiting device for controlling the movement of said actuator between said inoperative position and said operative position.

4. The apparatus of claim 1, wherein said mechanical linkage includes a rotatable device; and wherein said rotatable device contains a first surface commensurate with said operative position and a second surface commensurate with said inoperative position; said first surface and said second surface having a height difference, and said height difference minus the lash set by said lash adjusting system determining said modified engine valve lift for said engine valve event.

5. The apparatus of claim 1, wherein said mechanical linkage includes a slidable device; and wherein said slidable device comprises a plunger, said plunger being slidably disposed in said lash adjusting system between said inoperative position and said operative position; said inoperative position and said operative position having a height difference, and said height difference minus the lash set by said lash adjusting system determining said modified engine valve lift for said engine valve event.

6. The apparatus of claim 1, wherein said mechanical linkage includes a ball-locking device; and wherein said ball-locking device comprises a plurality of balls, a ball-locking piston, a braking piston, and a spring; said braking piston being slidable in said lash adjusting system between said inoperative position and said operative position; in said inoperative position, said ball-locking device being retracted to an unlocked position; in said operative position, said ball-locking device being extended to a locked position; said extended position and said retracted position having a height difference, and said height difference minus the lash set by said lash adjusting system determining said modified engine valve lift for said engine valve event.

7. The apparatus of claim 1, wherein said mechanical linkage includes a toggle device; and wherein said toggle device comprises a couple of pins, at least one pin-locking piston, a braking piston, and a spring; said braking piston being slidable in said lash adjusting system between said inoperative position and said operative position; in said inoperative position, said toggle device being retracted to an unlocked position; in said operative position, said toggle device being extended to a locked position; said extended position and said retracted position having a height difference, and said height difference minus the lash set by said lash adjusting system determining said modified engine valve lift for said engine valve event.

8. The apparatus of claim 1, further comprising a valve bridge, wherein said mechanical linkage is disposed in said valve bridge between said inoperative position and said operative position; wherein said inoperative position and said operative position have a height difference, and wherein said height difference minus the lash set by said lash adjusting system determine said modified engine valve lift for said engine valve event.

9. The apparatus of claim 1, further comprising a rocker arm, wherein said mechanical linkage is disposed in said rocker arm between said inoperative position and said operative position; wherein said inoperative position and said operative position have a height difference, and wherein said height difference minus the lash set by said lash adjusting system determine said modified engine valve lift for said engine valve event.

10. The apparatus of claim 1, wherein said operative position and said inoperative position comprise two surfaces, said two surfaces having a height difference, and said height difference minus the lash set by said lash adjusting system determining said modified engine valve lift for said engine valve event.

11. The apparatus of claim 1, wherein said operative position and said inoperative position are on one surface, said one surface providing a lift when said actuator is moved from said inoperative position to said operative position, and said lift minus the lash set by said lash adjusting system determining said modified engine valve lift for said engine valve event.

12. The apparatus of claim 1, further comprising a lift profile for said at least one exhaust valve, said lift profile comprising a predetermined valve seating ramp for reducing impact load between said actuator and said at least one exhaust valve, and said predetermined valve seating ramp starting before the at least one exhaust valve contacts said actuator.

13. The apparatus of claim 1, wherein said controller comprises at least one system selected from the group consisting of: a hydraulic system, mechanical system, electric system, magnetic system, and combined system thereof.

14. The apparatus of claim 13, wherein said combined system comprises an electromechanical system, said electromechanical system comprising an electric motor, and said electric motor moving said actuator between said inoperative position and said operative position with a predetermined motion.

15. The apparatus of claim 13, wherein said combined system further comprises an electrohydromechanical system; said electrohydromechanical system comprising a fluid circuit formed in said actuator and said engine, a flow controller for supplying and cutting off fluid flow to said actuator through said fluid circuit, and a flow actuating device for moving said actuator; said flow controller comprising a three-way solenoid valve or a two-way solenoid valve plus a bleeding orifice, and said flow actuating device comprising fluid and mechanical interaction.

16. A method of modifying engine valve lift to produce an engine valve event in an internal combustion engine, the engine including at least one engine valve and an engine valve lifter for cyclically opening and closing the at least one engine valve, said method comprising the steps of:

(a) providing an actuator having an inoperative position and an operative position, wherein in said inoperative position said actuator is disengaged from the operation of the at least one engine valve; said actuator comprising a mechanical linkage for transmitting a load generated by said engine valve event, said actuator further comprising a lash adjusting system for setting a lash between said actuator and the at least one engine valve;

(b) providing a controller for moving said actuator between said inoperative position and said operative position;

(c) opening the at least one engine valve to produce said modified engine valve lift for said engine valve event; and (d) transmitting a load from said engine valve event by said mechanical linkage.

17. The method of claim 16, further comprising the steps of:

(a) providing a motion limiting device incorporated into said actuator;

(b) setting a lash between said actuator and said engine valve by said lash adjusting system;

(c) controlling the movement of said actuator between said inoperative position and said operative position through said motion limiting device; and (d) generating said modified engine valve lift from said movement and said lash.

* * * * *